US008821207B1

(12) United States Patent
Hart

(10) Patent No.: US 8,821,207 B1
(45) Date of Patent: Sep. 2, 2014

(54) METHOD FOR TEACHING SKILLS TO A CHILD AND APPARATUS THEREFOR

(76) Inventor: Sheila Adams Hart, Redmond, WA (US)

( * ) Notice: Subject to any disclaimer, the term of this patent is extended or adjusted under 35 U.S.C. 154(b) by 682 days.

(21) Appl. No.: 12/931,264

(22) Filed: Jan. 27, 2011

Related U.S. Application Data

(60) Provisional application No. 61/337,291, filed on Feb. 2, 2010.

(51) Int. Cl.
*A63H 33/04* (2006.01)

(52) U.S. Cl.
USPC ..... 446/85; 446/476; 446/487; 24/306; 24/442; 24/447; 428/100; 434/72; 434/74; 434/79

(58) Field of Classification Search
USPC ..... 434/72, 74, 79; 24/306, 442, 447; 428/100; 446/85, 476–78, 487, 110, 446/111
See application file for complete search history.

(56) References Cited

U.S. PATENT DOCUMENTS

| | | | | |
|---|---|---|---|---|
| 4,212,130 | A * | 7/1980 | Walker | 446/111 |
| 4,306,371 | A * | 12/1981 | Walmer et al. | 446/110 |
| 4,514,175 | A * | 4/1985 | Zaruba et al. | 434/82 |
| 4,569,664 | A * | 2/1986 | Giampetruzzi et al. | 446/110 |
| 4,884,988 | A * | 12/1989 | McMurray | 446/115 |
| 4,946,414 | A * | 8/1990 | Zimmer | 446/71 |
| 4,964,249 | A * | 10/1990 | Payne | 52/70 |
| 4,978,301 | A * | 12/1990 | Dodge | 434/96 |
| 5,007,569 | A * | 4/1991 | Zarb | 224/275 |
| 5,330,379 | A * | 7/1994 | Roh et al. | 446/71 |
| 5,423,709 | A * | 6/1995 | Summers | 446/478 |
| 5,458,522 | A * | 10/1995 | Brooks, III | 446/85 |
| 5,498,188 | A * | 3/1996 | Deahr | 446/75 |
| 5,525,088 | A * | 6/1996 | Mayne | 446/75 |
| 5,537,793 | A * | 7/1996 | Murasaki | 52/585.1 |
| 5,620,325 | A * | 4/1997 | Glick | 434/258 |
| 5,634,245 | A * | 6/1997 | Rouser et al. | 24/452 |
| 5,707,269 | A * | 1/1998 | Murphy | 446/268 |
| 5,848,926 | A * | 12/1998 | Jardetzky et al. | 446/85 |
| 5,947,786 | A * | 9/1999 | Glick | 446/85 |
| 5,964,634 | A * | 10/1999 | Chang | 446/85 |
| 6,124,015 | A * | 9/2000 | Baker et al. | 428/99 |
| 6,554,685 | B2 * | 4/2003 | Lish | 446/487 |
| 6,565,413 | B2 * | 5/2003 | Brownrigg | 446/476 |
| 6,568,981 | B1 * | 5/2003 | Chang | 446/85 |
| 6,626,678 | B2 * | 9/2003 | Forbes et al. | 434/247 |
| 6,923,705 | B2 * | 8/2005 | DeSalvo et al. | 446/106 |
| 7,104,864 | B1 * | 9/2006 | Liou | 446/221 |
| 7,241,198 | B1 * | 7/2007 | Boone | 446/476 |
| 7,552,563 | B2 * | 6/2009 | Becker | 52/79.5 |
| 7,976,395 | B2 * | 7/2011 | Healey | 472/75 |
| 2003/0153243 | A1 * | 8/2003 | Haas | 446/901 |
| 2004/0029088 | A1 * | 2/2004 | Forbes et al. | 434/236 |
| 2005/0039312 | A1 * | 2/2005 | Tanokura et al. | 24/442 |
| 2008/0242188 | A1 * | 10/2008 | Yanagita | 446/85 |
| 2009/0298385 | A1 * | 12/2009 | Brinckerhoff | 446/487 |

* cited by examiner

*Primary Examiner* — Gene Kim
*Assistant Examiner* — Urszula M Cegielnik
(74) *Attorney, Agent, or Firm* — Ted Masters

(57) ABSTRACT

A method and apparatus for teaching skills to a child includes a toy barn kit which has a plurality of structural elements including walls, gables, and roof panels which can be assembled into a completed toy barn. The structural elements have color coded connectors and mating connectors which assist the child in the assembly process. In performing the assembly, the child learns skills of (1) principles of construction, (2) spatial relationships, (3) sequential thinking, and (4) color recognition and matching.

1 Claim, 23 Drawing Sheets

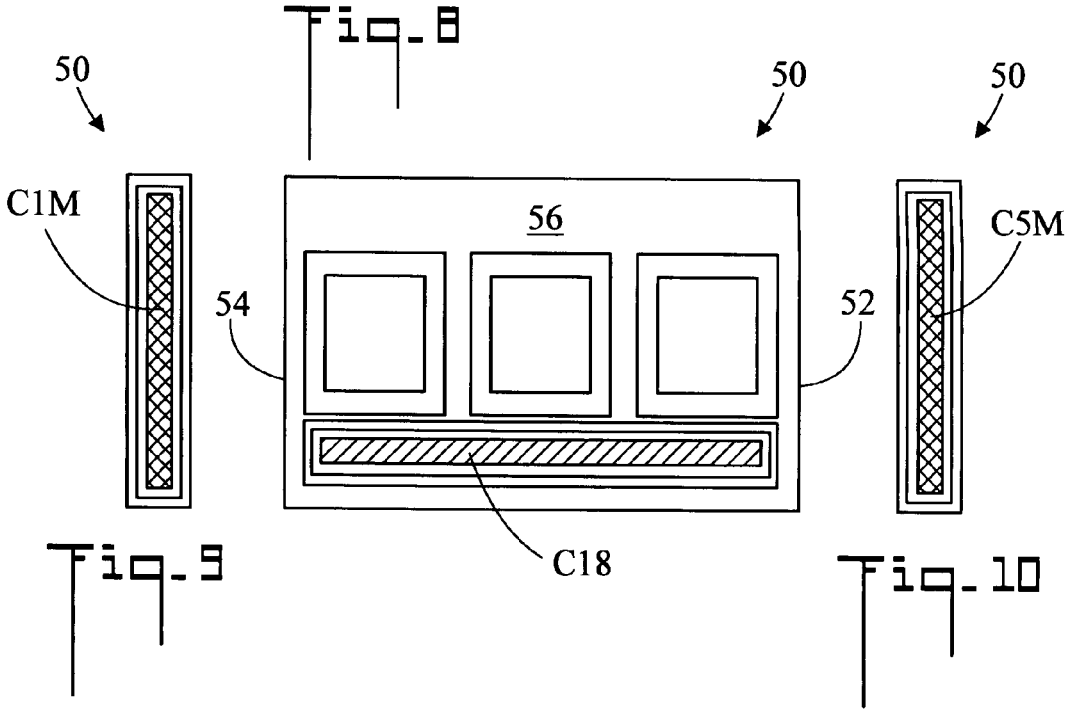
Fig. 8
50
50
50
C1M
56
C5M
54
52
C18
Fig. 9
Fig. 10
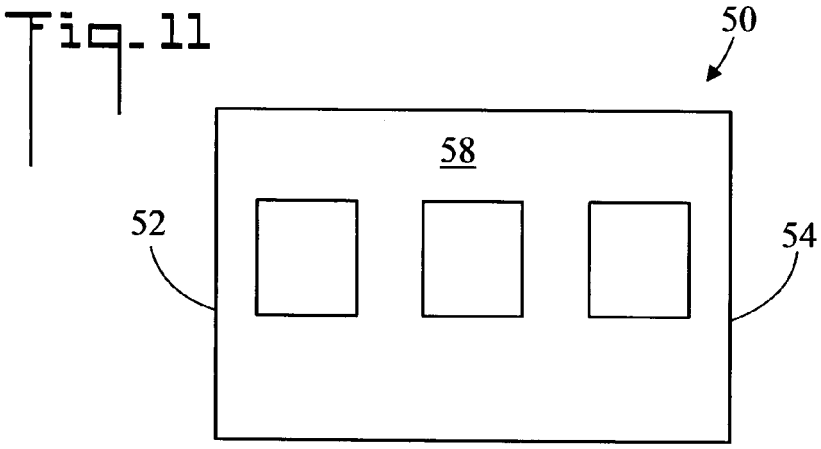
Fig. 11
50
58
52
54

Fig. 12
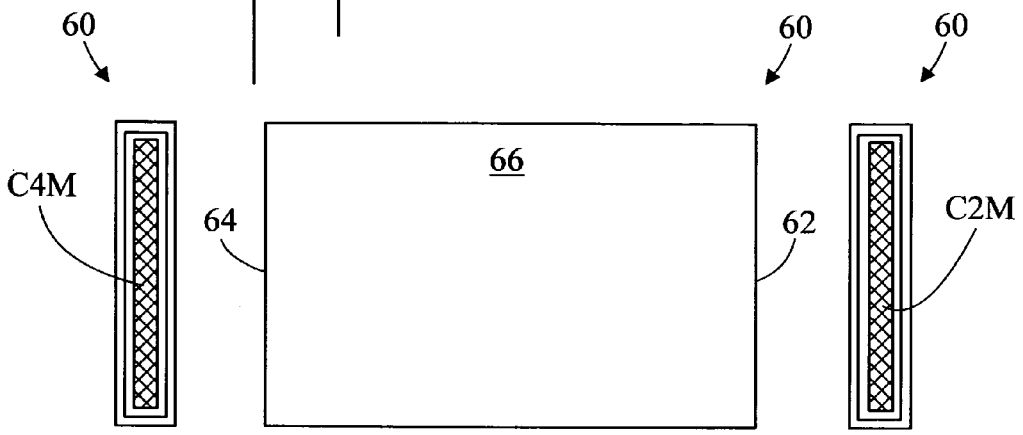
Fig. 13
Fig. 14
Fig. 15
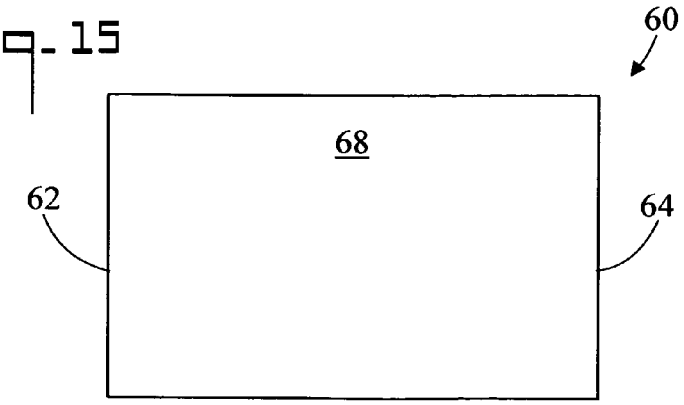

Fig. 38
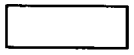
Fig. 39
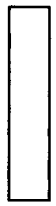
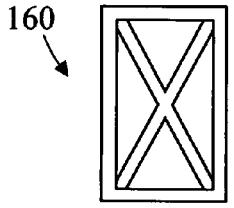
Fig. 37
Fig. 41
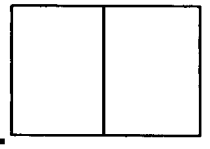
Fig. 42
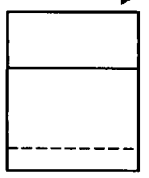
Fig. 40
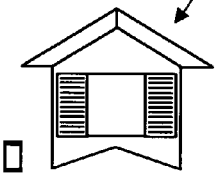
Fig. 43
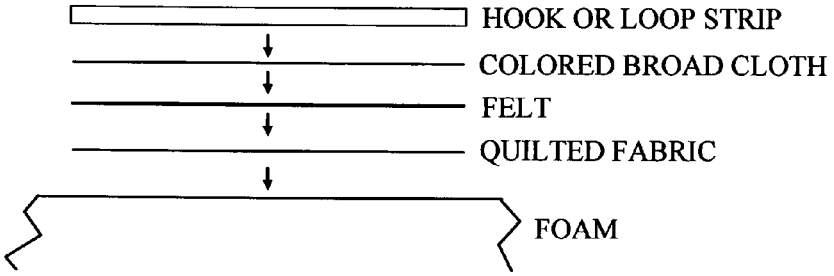

METHOD FOR TEACHING SKILLS TO A CHILD AND APPARATUS THEREFOR

CROSS REFERENCE TO RELATED APPLICATION

This application claims the filing benefit under 35 U.S.C. §119(e) of U.S. Provisional Application No. 61/337,291 filed Feb. 2, 2010, which is hereby incorporated by reference.

TECHNICAL FIELD

The present invention pertains generally to teaching certain skills to a child, and more particularly to a toy barn kit which is made out of soft materials and which a child can assemble and play with thereby learning new skills.

BACKGROUND OF THE INVENTION

Young children benefit from interacting with toys which teach them skills such as construction, spatial relations, sequential thinking, balance, and color recognition Such toys can both be fun to play with, and can teach principles which are useful in later life. A construction-based toy is particularly useful in this regard.

BRIEF SUMMARY OF THE INVENTION

The present invention is directed to a multi-piece toy barn kit for children. The pieces comprise structural members which can be sequentially assembled by the child to form a toy barn. The pieces of the kit are covered with soft quilted material, and are connected using color coded connectors (such as hook and loop fasteners). The purpose of this invention is to teach specific principles of construction, sequential thinking, i.e. "what to do first", the ground floor, then the second story, then the roof, then the cupola, then the hay trough and the barn doors. The child learns through color matching which pieces fit together, before he or she learn the actual structural reason for the pieces fitting together. Repeated assembly of the barn pieces teaches spatial relations concepts, color matching, rotation of objects, coordination of parts-of-a whole, interiors and exteriors, tactile variations and the functional purpose of each of the parts. The present invention specifically assists and benefits very young children.

Beyond creative play value, the barn kit of the present invention is intended to be used by preschool age children to provide a context for playing with toy farm animals, which can be used in conjunction with the toy barn. The children learn time, place, mode and object concepts through the general game of pretend farming. The time element is learned through practice of sequential steps. For example, the animals come back into the barn, to eat hay, and go to sleep. Then in the morning they leave the barn, to go out in the fields, etc. The mode, has to do with what each animal does and how. The place learning has to do with where, the various pieces of the barn fit, their purpose, the order of assembly, the associated learning about the place that farm animals have in nature, how do they do what they do,—in and out of the barn—and the object concepts are about what are the specifics associated with each element of the barn, the various parts, the sequential order of the assembly and disassembly processes, the nature of the various animals, their relationship to the barn, the hay trough, the window, the barn door, etc.

In addition, the child gains self esteem via the process of mastering the building of the barn. As early as the age of 18 months, young children begin the ever increasing quest toward individuation and mastery. They want to "do it myself"! The barn provides the opportunity to learn how to build a structure themselves. Children gain self esteem and confidence each and every time they play with this barn. After the third time they have built it, and it's put back in the box, they begin to "see" it finished, in their imaginations. When asked what each piece is and what it's for, they feel excited and proud when they conceptually "know" how it all fits together. Several children can also work together as a team. And this is an additional advantage—the teamwork assembly is it's own opportunity to work with cooperative others on a common mission to achieve a goal that benefits them all. Some of the major creative play value benefits are pride, confidence and higher intellect, higher self-esteem. The present invention offers all the above.

In a preferred embodiment, a barn kit includes four walls, two gables, and four roof panels. The four walls connect to form a rectangular structure. The two gables are placed on the front and rear walls, and the four roof panels are placed on top of the gables. Each of the pieces has one or more color coded connectors which connect to a mating piece having the same color connector (i.e. connector pairs). All of the connector pairs are a different color, so the child is guided in the assembly process.

In accordance with another embodiment, the four roof panels connect together to form a four panel roof assembly.

In accordance with another embodiment, the inner surfaces and the edges of the roof panels are covered with a stretchable fabric.

In accordance with another embodiment, the front wall, the rear wall, the first side wall, the second side wall, the first gable, the second gable, the first roof panel, the second roof panel, the third roof panel, and the fourth roof panel each include a foam body which is covered with at least one type of fabric selected from the group of (1) quilted fabric, and (2) 100% polyester fabric.

In accordance with another embodiment, the front wall includes a door opening. A barn door is shaped and dimensioned to removable fit into the door opening but not connect to the front wall.

In accordance with another embodiment, the barn includes a hay trough which can be removably mounted on the exterior surface of the first side wall below a window opening.

In accordance with another embodiment, the barn includes a cupola which is shaped and dimensioned to removably rest on the first roof panel and on the second roof panel, the cupola is not fixedly connectable to the first and second roof panels.

In accordance with another embodiment, the connectors include the following layers;

- a layer of hook or loop material;
- a layer of colored broad cloth disposed underneath the hook or loop material;
- a layer of felt disposed underneath the colored broad cloth;
- a layer of quilted fabric disposed underneath the felt;
- a layer of foam; and,
- the layer of hook or loop material sewn to the layer of colored broad cloth;
- the layer of colored broadcloth sewn to the layer of felt; and,
- all of the layers glued together.

Other possible embodiments, in addition to the possible embodiments enumerated above, will become apparent from the following detailed description, taken in conjunction with the accompanying drawings, which illustrate, by way of example, the principles of the method and apparatus.

BRIEF DESCRIPTION OF THE DRAWINGS

FIG. 8 is an elevation view of the exterior of a first side wall;

FIG. 9 is an elevation view of the first end of the first side wall;

FIG. 10 is an elevation view of the second end of the first side wall;

FIG. 11 is an elevation view of the interior of the first side wall;

FIG. 12 is an elevation view of the exterior of a second side wall;

FIG. 13 is an elevation view of the first end of the second side wall;

FIG. 14 is an elevation view of the second end of the second side wall;

FIG. 15 is an elevation view of the interior of the second side wall;

FIG. 37 is a front elevation view of a barn door;

FIG. 38 is a top plan view of the barn door;

FIG. 39 is a side elevation view of the barn door;

FIG. 40 is a front elevation view of a cupola;

FIG. 41 is a top plan view of the cupola;

FIG. 42 is a side elevation view of the cupola;

FIG. 43 is an enlarged exploded view of area 43 of FIG. 2;

FIG. 48 is a perspective view of the second side wall connected to the front and rear walls;

DETAILED DESCRIPTION OF THE INVENTION

Figure 1:
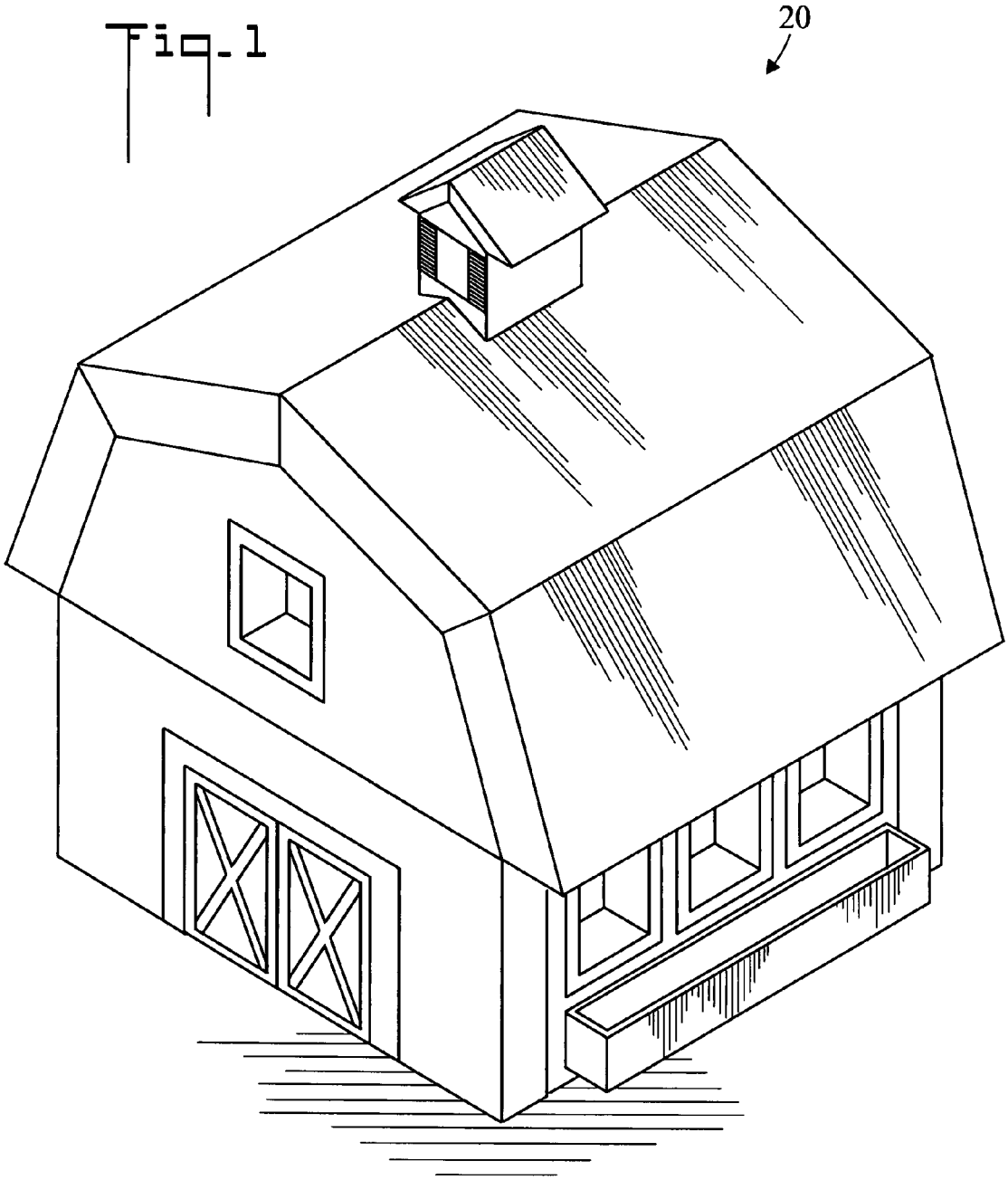
FIG. 1 is a perspective view of an assembled toy barn.

Referring initially to FIG. 1, there is illustrated a perspective view of an assembled toy barn, generally designated as 20. Toy barn 20 comes as a toy barn kit which has a plurality of pieces, which are depicted in FIGS. 2 through 42. The toy barn kit apparatus is useful in teaching various skills to a child.

Figure 3:
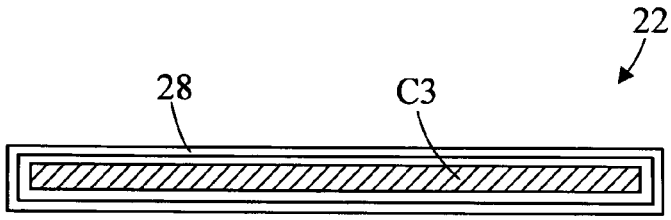
FIG. 3 is a top plan view of the front wall.
Figure 2:
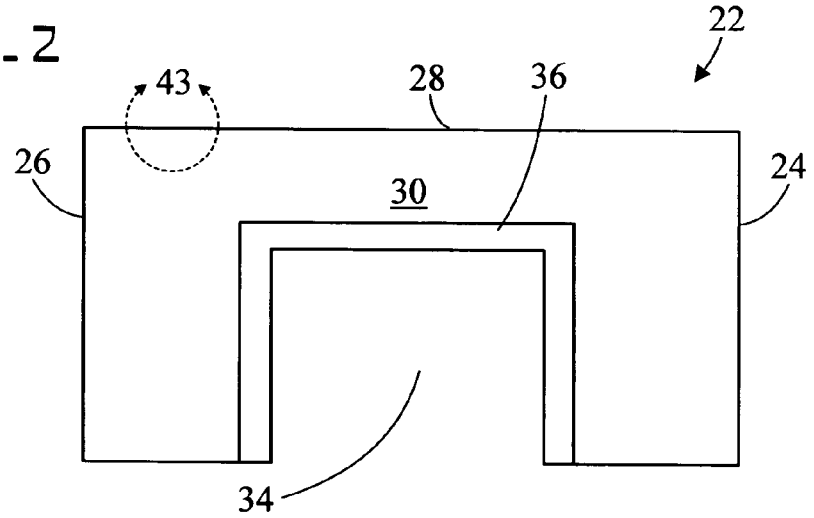
FIG. 2 is an elevation view of the exterior of a front wall.
Figure 4:
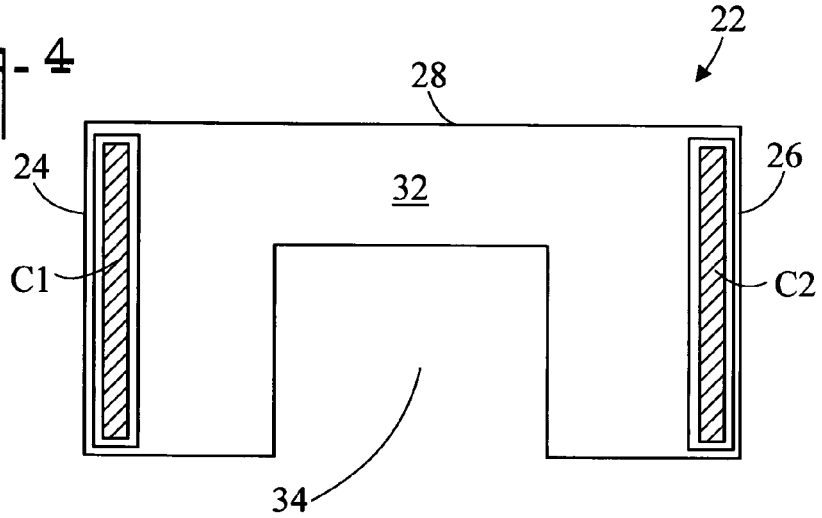
FIG. 4 is an elevation view of the interior of the front wall.

FIGS. 2 through 4 are exterior elevation, top plan, and interior elevation views respectively of a front wall 22. Front wall 22 has a first end 24, an opposite second end 26, and a top edge 28. A first connector C1 of a first color is disposed at first end 24, a second connector C2 of a second color is disposed at second end 26, and a third connector C3 of a third color is disposed at top edge 28. Front wall 22 also has an exterior surface 30 and an opposite interior surface 32. As defined herein, the term "disposed at a first end" can embrace either a location near the end as in FIG. 4, or a location on the actual edge of the end as in FIG. 9. In FIG. 2 it is noted that front wall 22 has a door opening 34 which accepts a barn door (refer to FIGS. 37-39). A trim 36 is disposed around opening 34 as well as openings on other structural members of toy barn 20 described below.

In the shown embodiment, connectors C1, C2, and C3 (as well as other connectors to be discussed later) are strips (e.g. two inches wide) of either hook or loop fastener material which are mounted upon a colored fabric, which is in tern connected to a structural member such as a wall, gable, roof panel, etc (refer also to FIG. 43 and the associated discussion). In the drawings, connectors are depicted with hash lines and corresponding mating connectors are depicted with cross hatched lines. The only requirement is that in a mating pair of connectors (e.g. C1 and C1m), one of the pair has a hook fastener and the other has a loop fastener. It may be appreciated however that other types of connectors (e.g. buttons, snaps, or the like) could also be used to connect the various pieces of toy barn 20.

Figure 6:
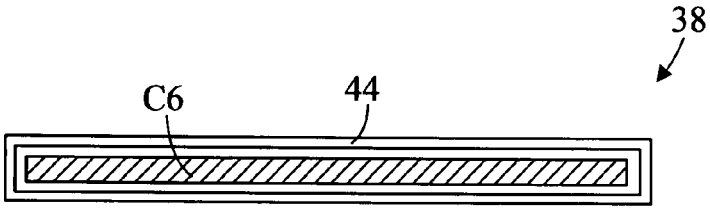
FIG. 6 is a top plan view of the rear wall.
Figure 5:
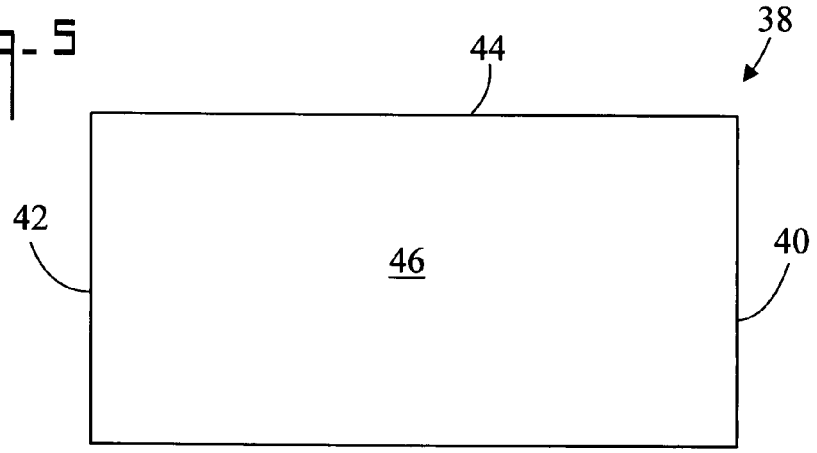
FIG. 5 is an elevation view of the exterior of a rear wall.
Figure 7:
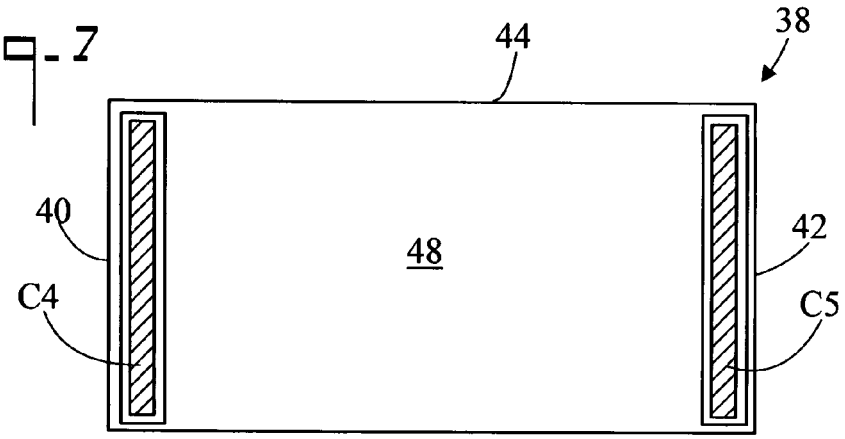
FIG. 7 is an elevation view of the interior of the rear wall.
Figure 17:
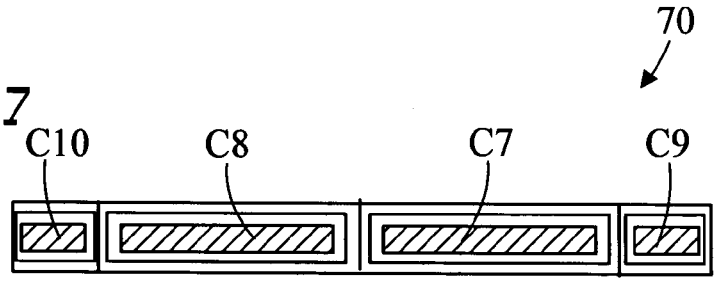
FIG. 17 is a top plan view of the first gable.
Figure 16:
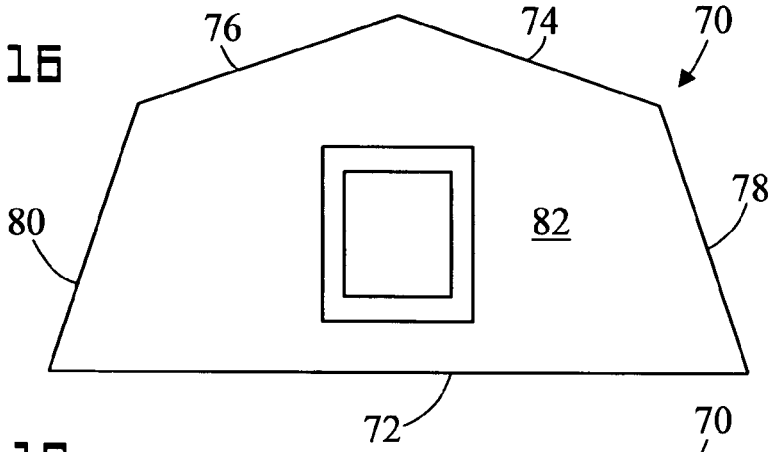
FIG. 16 is an elevation view of the exterior of a first gable.
Figure 18:
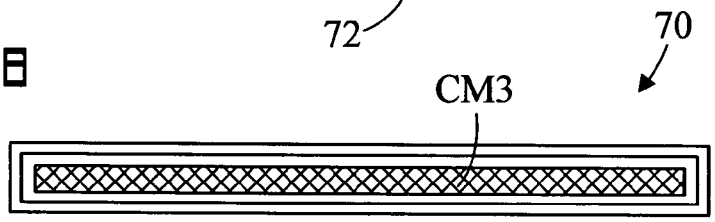
FIG. 18 is a bottom plan view of the first gable.
Figure 19:
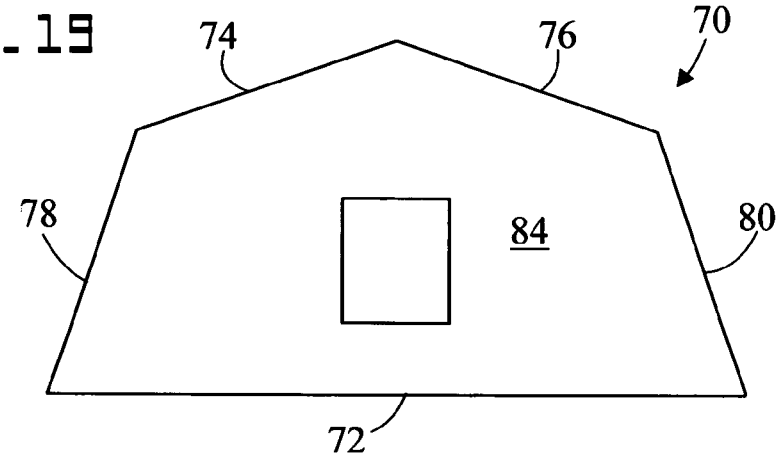
FIG. 19 is an elevation view of the interior of the first gable.
Figure 21:
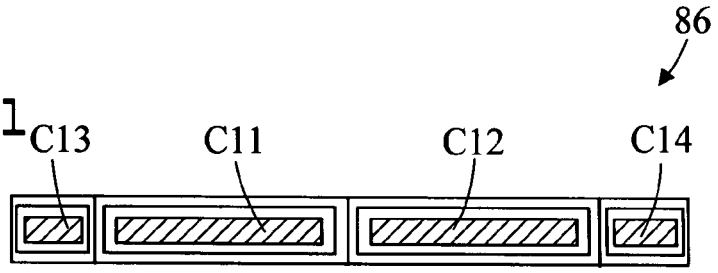
FIG. 21 is a top plan view of the second gable.
Figure 20:
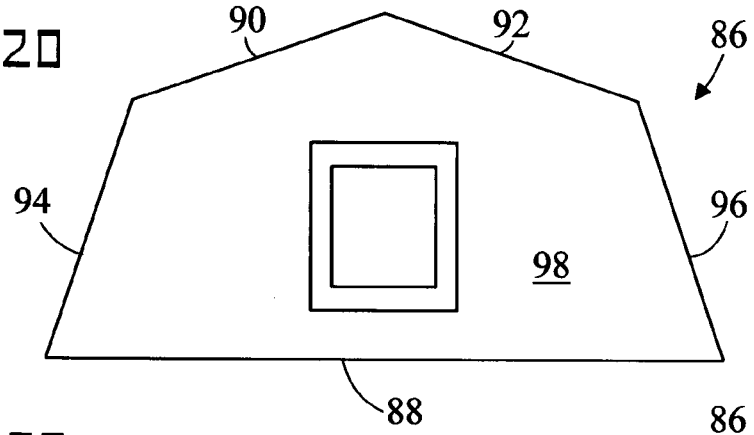
FIG. 20 is an elevation view of the exterior of a second gable.
Figure 22:
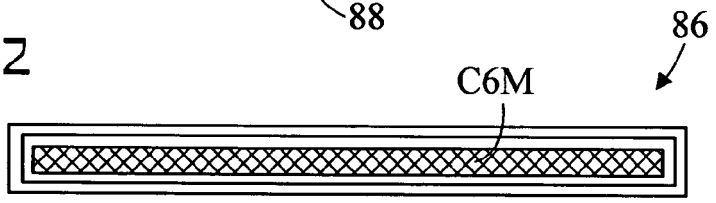
FIG. 22 is a bottom plan view of the second gable.
Figure 23:
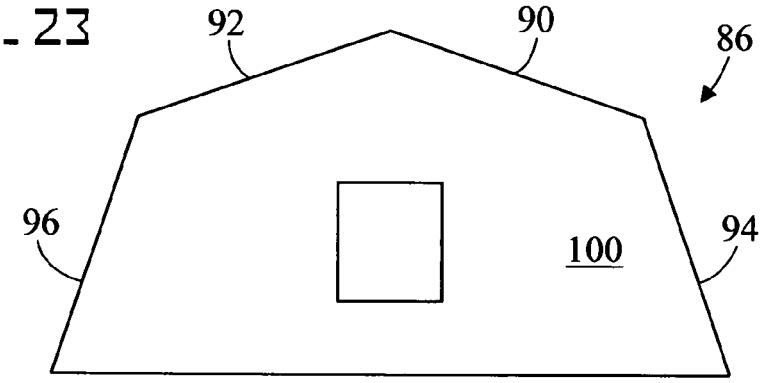
FIG. 23 is an elevation view of the interior of the second gable.

FIGS. 5 through 7 are exterior elevation, top plan, and interior elevation views respectively of a rear wall 38. Rear wall 38 has a first end 40, an opposite second end 42, and a top edge 44. A fourth connector C4 of a fourth color is disposed at first end 40, a fifth connector C5 of a fifth color is disposed at second end 42, and a sixth connector C6 of a sixth color is disposed at top edge 44. Rear wall 38 also has an exterior surface 46 and an opposite interior surface 48.

FIGS. 8-11 are exterior elevation, end elevation, opposite end elevation, and interior elevation views respectively of a first side wall 50 which is removably connectable to front wall 22 and to rear wall 38. First side wall 50 has a first end 52 and an opposite second end 54, a mating fifth connector C5M of fifth color C5 is disposed at first end 52 and a mating first connector C1M of first color C1 is disposed at second end 54. Mating fifth connector C5M mates with (removably connects to) connector C5 of rear wall 38 (refer to FIGS. 5-7), and mating first connector C1M mates with connector C1 of front wall 22 (refer to FIGS. 2-4). That is, in the shown hook and loop embodiment, first connector C1 of front wall 2 contains one of hooks and loops, and mating connector C1M of first side wall 50 contains the other of hooks and loops. First side wall 50 also has an exterior surface 56 and an opposite interior surface 58.

FIGS. 12-16 are exterior elevation, end elevation, opposite end elevation, and interior elevation views respectively of a second side wall 60 which is removably connectable to front wall 22 and rear wall 38. Second side wall 60 has a first end 62 and an opposite second end 64, a mating second connector C2M of second color C2 disposed at first end 62 and a mating fourth connector C4M of fourth color C4 disposed at second end. 64. Second side wall 60 has an exterior surface 66 and an opposite interior surface 68.

FIGS. 16 through 19 are exterior elevation, top plan, interior elevation, and bottom plan views respectively of a first gable 70 which is removably connectable to front wall 22. First gable 70 has a bottom edge 72, a first upper side edge 74, and opposite second upper side edge 76, a first lower side edge 78, and an opposite second lower side edge 80. A mating third connector C3M of color C3 is disposed at bottom edge 72, a seventh connector of a seventh color C7 is disposed at first upper side edge 74, an eighth connector C8 of an eighth color is disposed at second upper side edge 76, a ninth connector C9 of a ninth color is disposed at first lower side edge 78, and a tenth connector C10 of a tenth color is disposed at second lower side edge 80. First gable 70 has an exterior surface 82 and an opposite interior surface 84

FIGS. 21 through 24 are exterior elevation, top plan, interior elevation, and bottom plan views respectively of a second gable 86 which is removably connectable to rear wall 38. Second gable 86 has a bottom edge 88, a first upper side edge 90, and opposite second upper side edge 92, a first lower side edge 94, and an opposite second lower side edge 96. A mating sixth connector CM6 of the sixth color is disposed at bottom edge 88, a eleventh connector C11 of a eleventh color is disposed at first upper side edge 90, a twelfth connector C12 of a twelfth color is disposed at second upper side edge 92, a thirteenth connector C13 of a thirteenth color is disposed at first lower side edge 94, and a fourteenth connector C14 of a fourteenth color is disposed at second lower side edge 96 Second gable 86 has an exterior surface 98 and an opposite interior surface 100.

Figure 24:
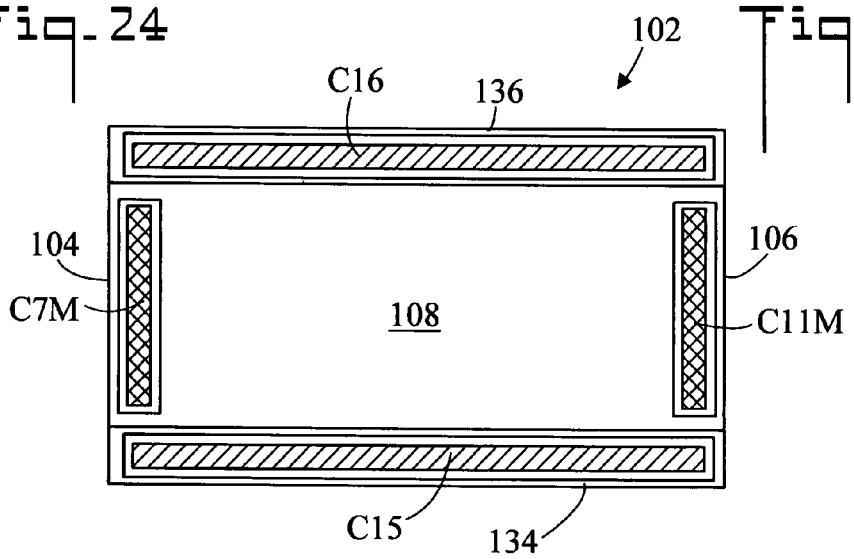
FIG. 24 is a view of the interior of a first roof panel.
Figure 25:
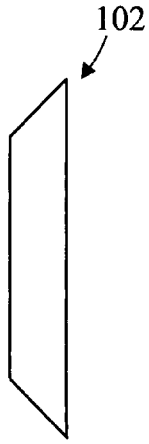
FIG. 25 is end view of the first roof panel.

FIGS. 24 and 25 are interior and end views of a first roof panel 102 which is removably connectable to first gable 70 and to second gable 86. First roof panel 102 has a first end 104 and an opposite second end 106, a mating seventh connector C7M of the seventh color is disposed at first end 104 and an mating eleventh connector C11M of the eleventh color is disposed at second end 106. First roof panel 102 has an interior surface 108.

Figure 26:
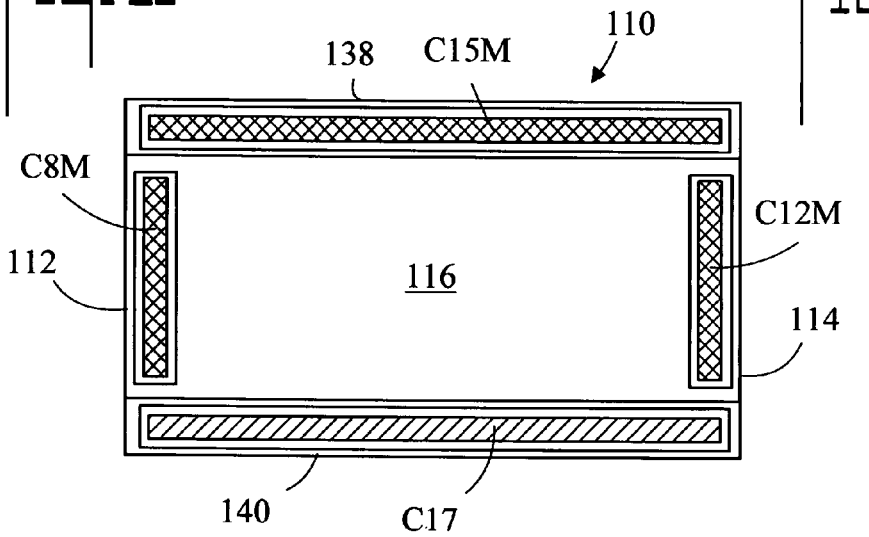
FIG. 26 is a view of the interior of a second roof panel.
Figure 27:
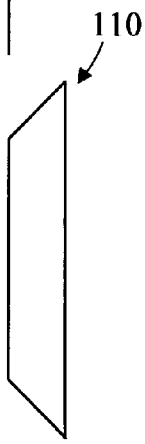
FIG. 27 is end view of the second roof panel.

FIGS. 26 and 27 are interior and end views of a second roof panel 110 which is removably connectable to first gable 70 and to second gable 86. Second roof panel 110 has a first end 112 and an opposite second end 114, a mating eighth connector C8M of the eighth color is disposed at first end 112 and an mating twelfth connector C12M of the twelfth color is disposed at second end 114. Second roof panel 110 has an interior surface 116.

Figure 28:
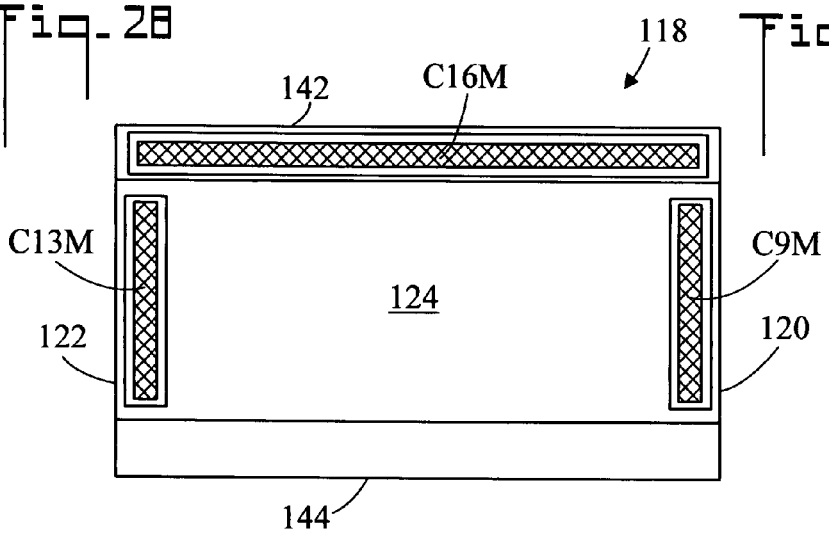
FIG. 28 is a view of the interior of a third roof panel.
Figure 29:
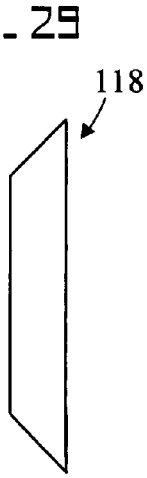
FIG. 29 is end view of the third roof panel.

FIGS. 28 and 29 are interior and end views of a third roof panel 118 which is removably connectable to first gable 70 and to second gable 86. Third roof panel 118 has a first end 120 and an opposite second end 122, a mating ninth connector C9M of the ninth color is disposed at first end 120 and a mating thirteenth connector C13M of the thirteen color is disposed at second end 122. Third roof panel 118 has an interior surface 124.

Figure 30:
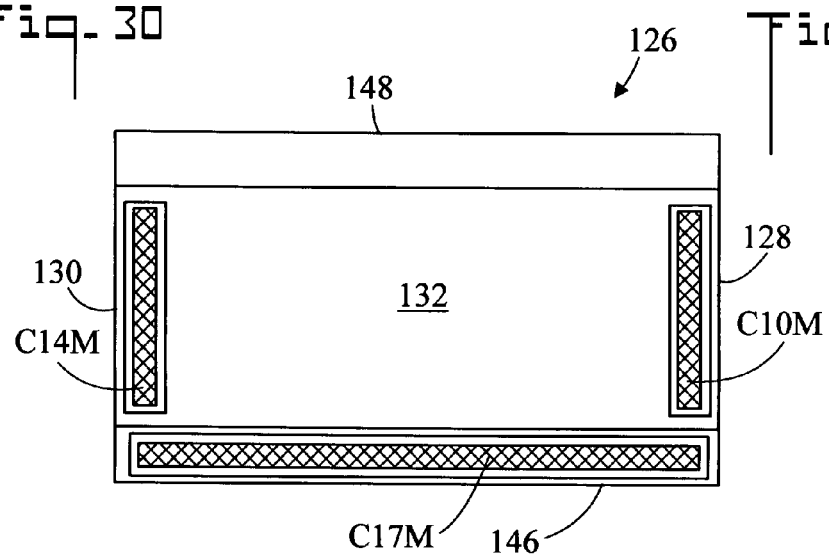
FIG. 30 is a view of the interior of a fourth roof panel.
Figure 31:
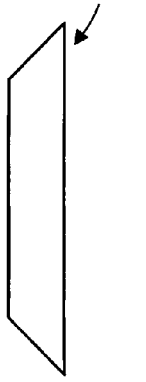
FIG. 31 is end view of the fourth roof panel.

FIGS. 30 and 31 are interior and end views of a fourth roof panel 126 which is removably connectable to first gable 70 and to second gable 86. Fourth roof panel 118 has a first end 128 and an opposite second end 130, a mating ninth connector C10M of the tenth color is disposed at first end 128 and a mating fourteenth connector C14M of the fourteenth color is disposed at second end 130. Fourth roof panel 126 has an interior surface 132.

In a very important feature, each of the connectors C1 through C14 is a different color (i.e. 14 different colors). In this fashion the child can color match a connector with a mating connector to effect the assembly of toy barn 20. For example connector C1 and mating connector CM1 could both be red. These two connectors are the only two red connectors in toy barn 20. Similar color pairs are used for all other connectors and mating connectors.

In an embodiment, front wall 22, rear wall 38, first side wall 50, second side wall 60, first gable 70, second gable 86, first roof panel 102, second roof panel 110, third roof panel 118, and fourth roof panel 126 each include a foam body which is covered with at least one type of fabric selected from the group of (1) quilted fabric, and (2) 100% polyester fabric. The polyester fabric can comprise a soft "fuzzy child friendly material. In an embodiment, a stretchable fabric is disposed on the inner surfaces (108, 116, 124, and 132) of each of the four roof panels (102, 110, 118, and 126 respectively) and on the four edges (two ends and two beveled sides).

Figure 32:
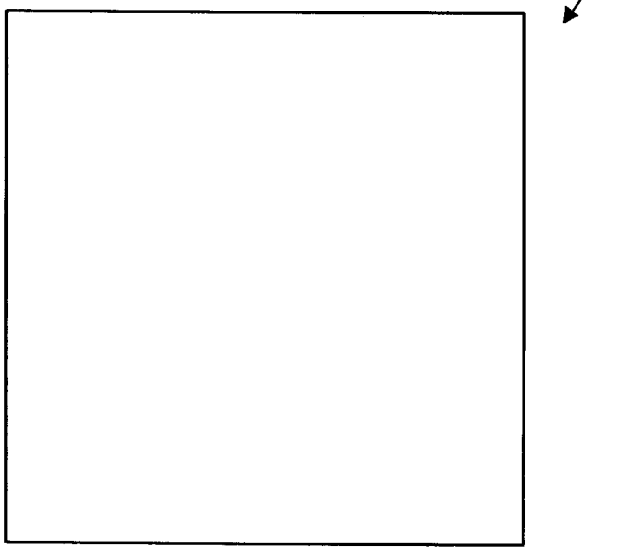
FIG. 32 is a top plan view of a floor.
Figure 33:
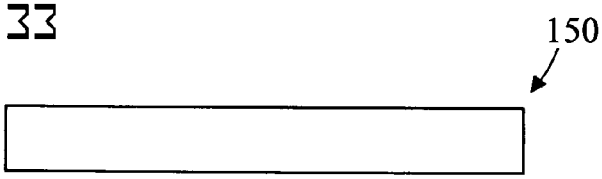
FIG. 33 is a side elevation view of the floor.

In an embodiment, in addition to connecting to first 70 and second gable 86, the four roof panels also connect to each other. Referring to FIGS. 24-31, first roof panel 102 is removably connectable to second roof panel 110 and to third roof panel 118. First roof panel 102 has a first edge 134 and an opposite second edge 136, a fifteenth connector C15 of a fifteenth color is disposed at first edge 134 and a sixteenth connector C16 of a sixteenth color is disposed at second edge 136. Second roof panel 110 is removably connectable to first roof panel 102 and to fourth roof panel 126. Second roof panel 110 has a first edge 138 and an opposite second edge 140, a mating fifteenth connector C15M of the fifteenth color is disposed at first edge 138 and a seventeenth connector C17 of a seventeenth color disposed at second edge 140. Third roof panel 118 is removably connectable to first roof panel 102. Third roof panel 118 has a first edge 142 and an opposite second edge 144, a mating sixteenth connector C17M of the sixteenth color is disposed at first edge 142. Fourth roof panel 126 removably connectable to second roof panel 110. Fourth roof panel 126 has a first edge 146 and an opposite second edge 148, a mating seventeenth connector C17M of the seventeenth color is disposed at first edge 148. As above, each of the first connector C1 through the seventeenth connector C17 is a different color FIGS. 32-33 are top plan and side elevation views respectively of a floor 150. Floor 150 is shaped and dimensioned to fit between front wall 22, rear wall 38, first side wall 50, and second side wall 60 (refer also to FIG. 48). Floor 150 can be put in place any time before the roof panels are installed. For example, in FIG. 45, floor 150 is used as a guide about which the walls are placed.

Figure 34:
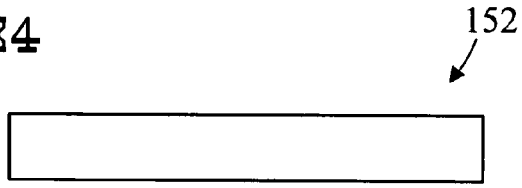
FIG. 34 is a front elevation view of a hay trough.
Figure 35:
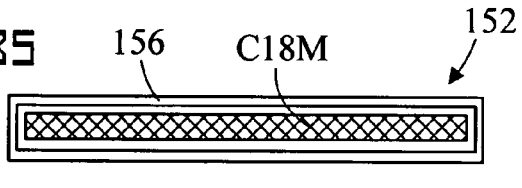
FIG. 35 is a rear elevation view of the hay trough.
Figure 36:
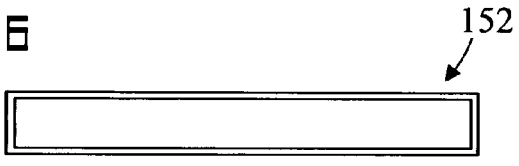
FIG. 36 is a top plan view of the hay trough.

FIGS. 34-36 are front elevation, rear elevation, and top plan views respectively of a hay trough 152. Returning to to FIG. 8, it is noted that first side wall 50 has at least one window opening 154 (three in the shown embodiment), and an eighteenth connector C18 of an eighteenth color is disposed on exterior surface 56 of first side wall 50 below window opening 154. Hay trough 152 has a rear surface 156, a mating eighteenth connector C18M of the eighteenth color is disposed on rear surface 156, so that hay trough 152 can be mounted on exterior surface 56 of first side wall 50 below window opening 154 (refer also to FIG. 52). As before, each of first connector C1 through the eighteenth connector C18 are a different color. In an embodiment, simulated hay can be disposed on the top of hay trough 152. In an embodiment, the child can place an animal (e.g. horse, cow, etc) inside toy barn 20 with the animals head extending out through window opening 154. The animal can be placed so that it appears to be eating hay from hay trough 152.

FIGS. 37-39 are front elevation, top plan, and side elevation views respectively of a barn door 160. Barn door 160 is shaped and dimensioned to removable fit into door opening 34 but not connect to front wall 22. In the shown embodiment, two identical barn doors 150 fit into door opening 34 in side-by-side relationship (refer to FIG. 55).

FIGS. 40-42 are front elevation, top plan, and side elevation views respectively of a cupola 162. Cupola 162 is shaped and dimensioned to removably rest on first roof panel 102 and on second roof panel 110, however cupola 162 is not fixedly connectable to the first 102 and second 110 roof panels.

FIG. 43 is an enlarged exploded view of area 43 of FIG. 2. In an embodiment, the connectors C1-C18 and mating connectors C1M-C18M comprise layers which are attached to foam structural members (i.e. front wall, rear wall, roof panels, etc). The outermost layer is a strip of hook or loop material. A layer of colored broad cloth is disposed underneath the hook or loop material, and the layer of hook or loop material is sewn to the layer of colored broad cloth. The color of the colored broad cloth is different from the color of the broadcloth of all other connectors. A layer of felt is disposed underneath the colored broad cloth, and the layer of colored broadcloth is sewn to the layer of felt. A layer of quilted fabric is disposed underneath the felt layer. The quilted fabric layer covers the entire structural member. The hook or loop layer, the colored broad cloth layer, the felt layer, and the quilted broadcloth layer are then glued to the foam structural member. In an embodiment, the foam is soft an flexible.

Figure 44:
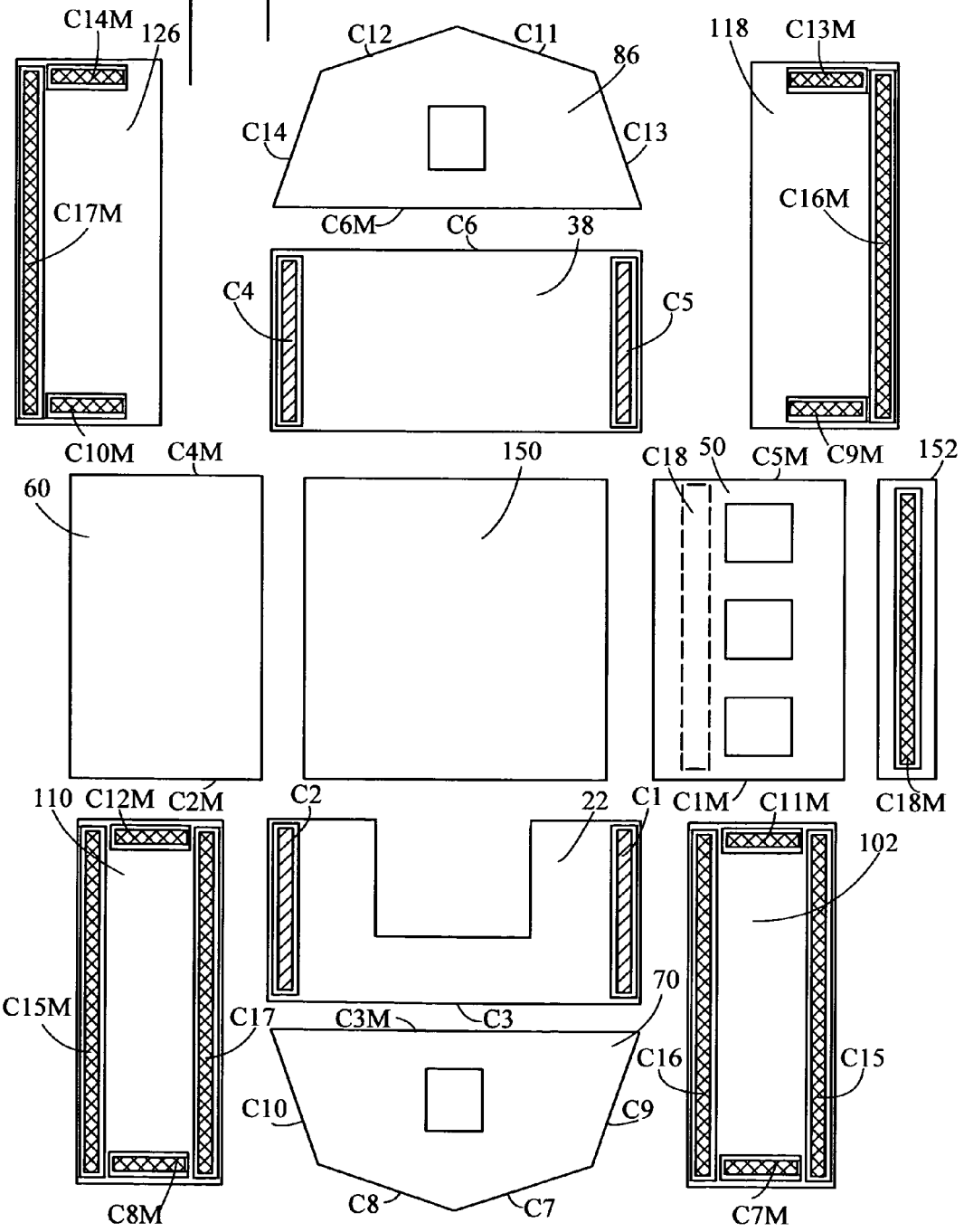
FIG. 44 is a reduced layout view of portions of the toy barn.

FIG. 44 is a reduced layout view of portions of toy barn 20. Each of the connecting structural members and associated connector numbers is shown.

FIGS. 45, and 47 through 55 show the assembly process of toy barn 20. It may be appreciated that these figures only so one possible sequence of assembly. For example rather than first connecting front wall 22 to first side wall 50, front wall 22 could be first connected to second side wall 60. Or, rather than first connecting the first roof panel, then the second roof then the third roof panel, then the fourth roof panel, the assembly order could be reversed, or otherwise altered. Certain assembly constraints however do exist, such as the gables must be connected before the roof panels are connected. Also, reference can be made to FIG. 44 to show the connector/mating connector pairs.

Figure 45:
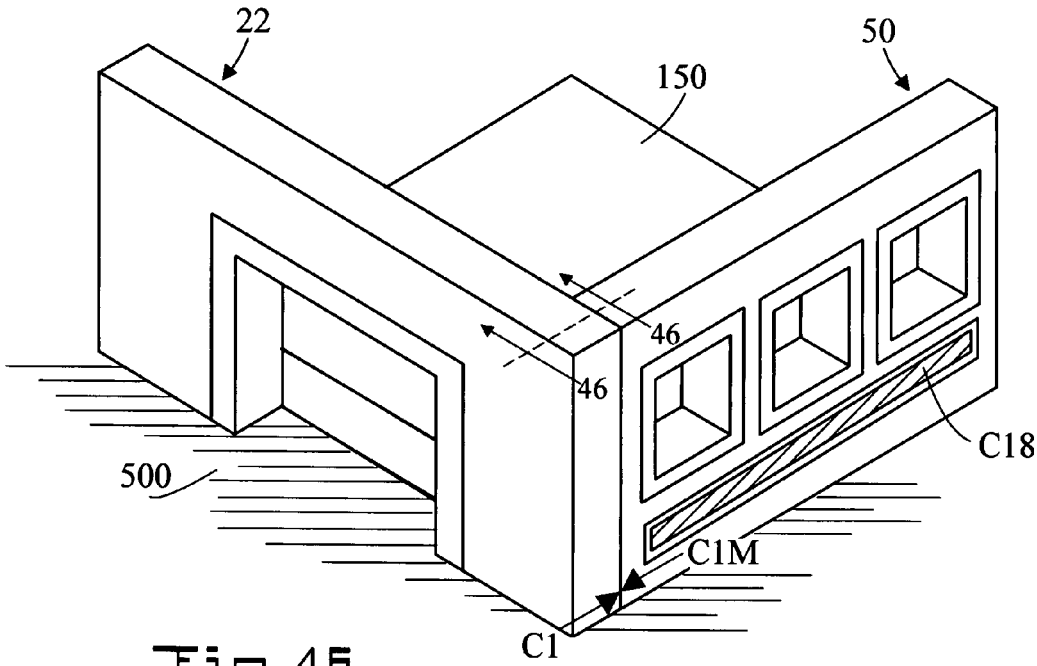
FIG. 45 is perspective view of the front wall connected to the first side wall of the toy barn.

FIG. 45 is perspective view of front wall 22 connected to first side wall 50 of toy barn 20 (C1-C1M connection, refer to FIG. 44). In the shown embodiment, floor 150 has been laid down as an assembly guide. Also shown is connector C18. It is further noted that the structural elements can be placed upon a support surface 500 such as a floor to effect the assembly process.

Figure 46:
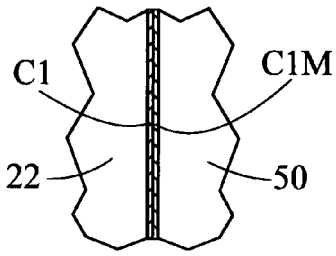
FIG. 46 is an enlarged cross sectional view along the line 46-46 of FIG. 45.

FIG. 46 is an enlarged cross sectional view along the line 46-46 of FIG. 45 showing connector C1 connected to mating connector C1M.

Figure 47:
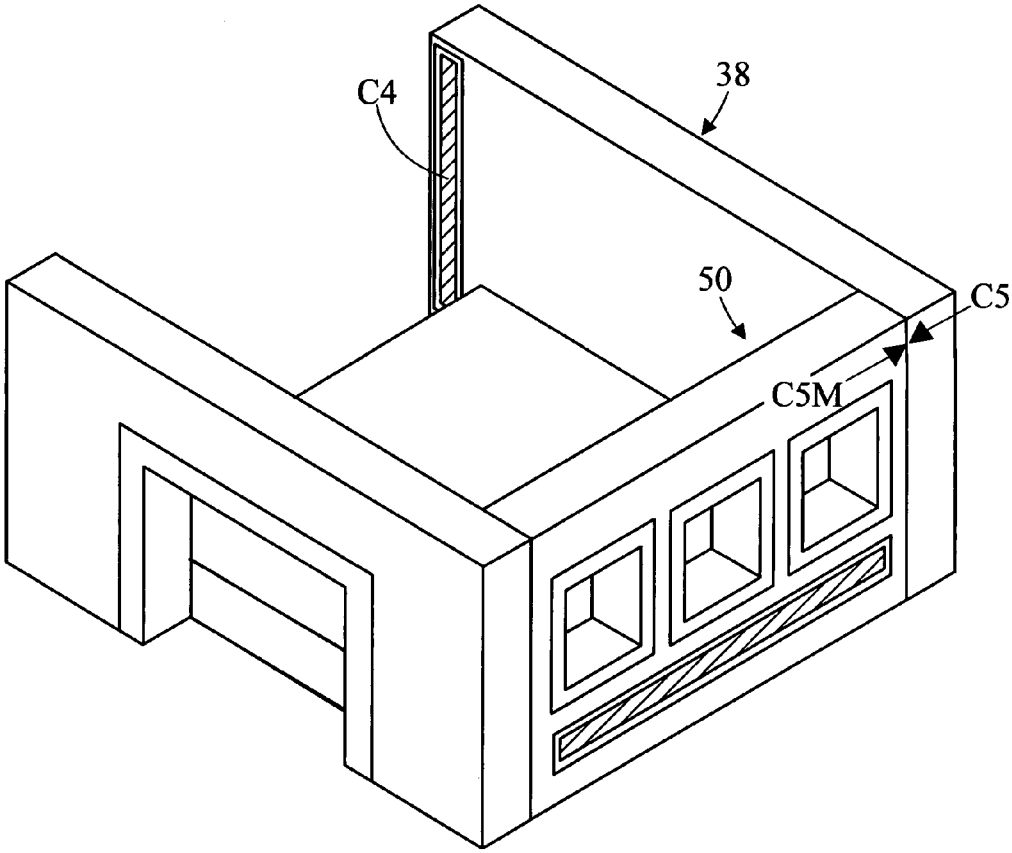
FIG. 47 is a perspective view of the rear wall connected to the first side wall.
Figure 4B:
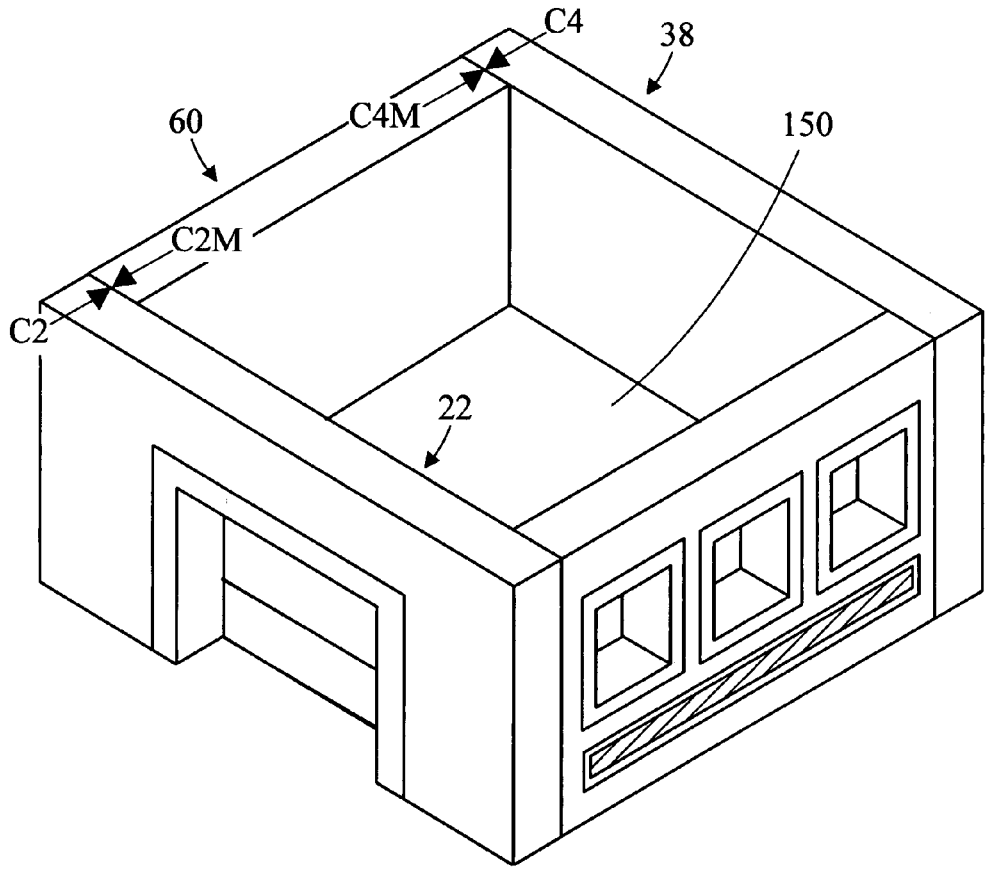

FIG. 47 is a perspective view of rear wall 38 connected to first side wall 50 (C2-C2M and C4-C4M connections). Also shown is fourth connector C4.

Figure 49:
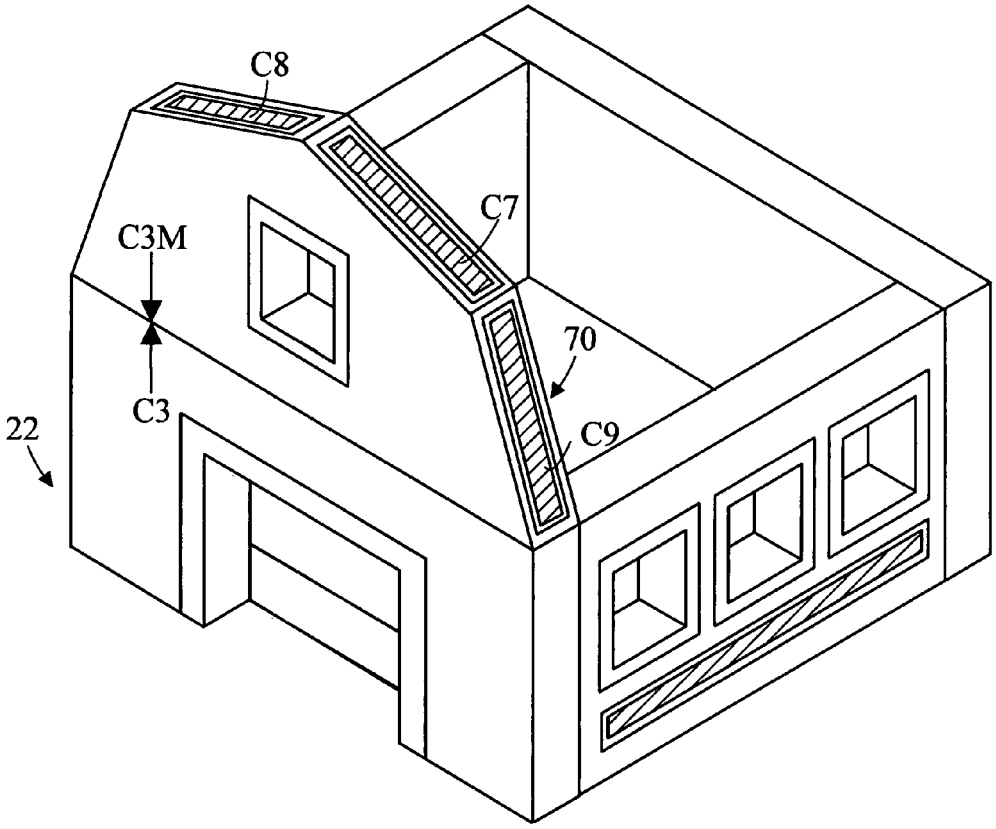
FIG. 49 is a perspective view of the first gable connected to the front wall.

FIG. 48 is a perspective view of second side wall 60 connected to the front 22 and rear 38 walls (C2-C2M and C4-C4M connections);

FIG. 49 is a perspective view of first gable 70 connected to front wall 22 (C3-C3M connection). Also shown are connectors C7, C8, and C9.

Figure 50:
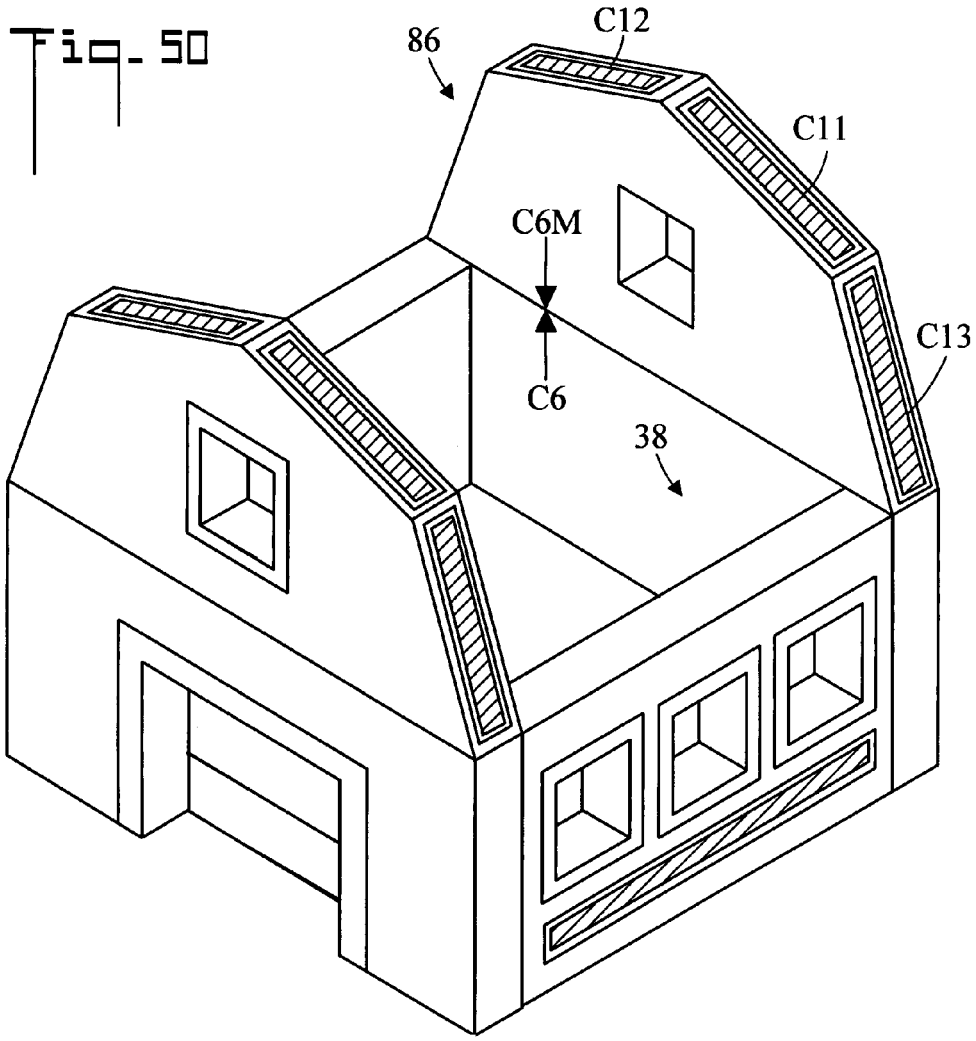
FIG. 50 is a perspective view of the second gable connected to the rear wall.

FIG. 50 is a perspective view of second gable 86 connected to rear wall 38 (C6-C6M connection). Also shown are connectors C7, C8, C9, C11M, C12M, and C13M.

Figure 51:
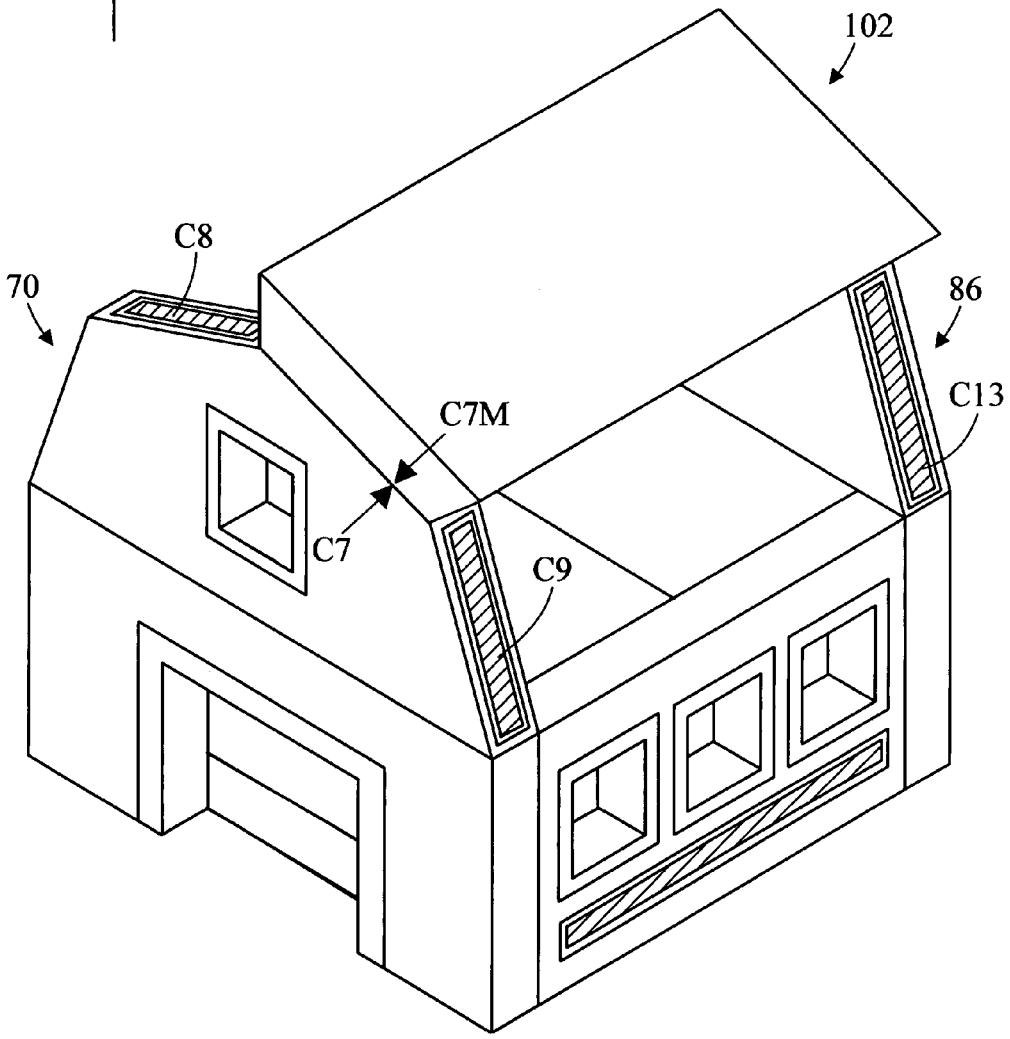
FIG. 51 is a perspective view of the first roof panel connected to the first gable and to the second gable.

FIG. 51 is a perspective view of first roof panel 102 connected to first gable 70 and to second gable 86 (C7-C7M connection and the C11-C11M connection (hidden)). Also shown are connectors C8, C9, and C12, and C13.

Figure 52:
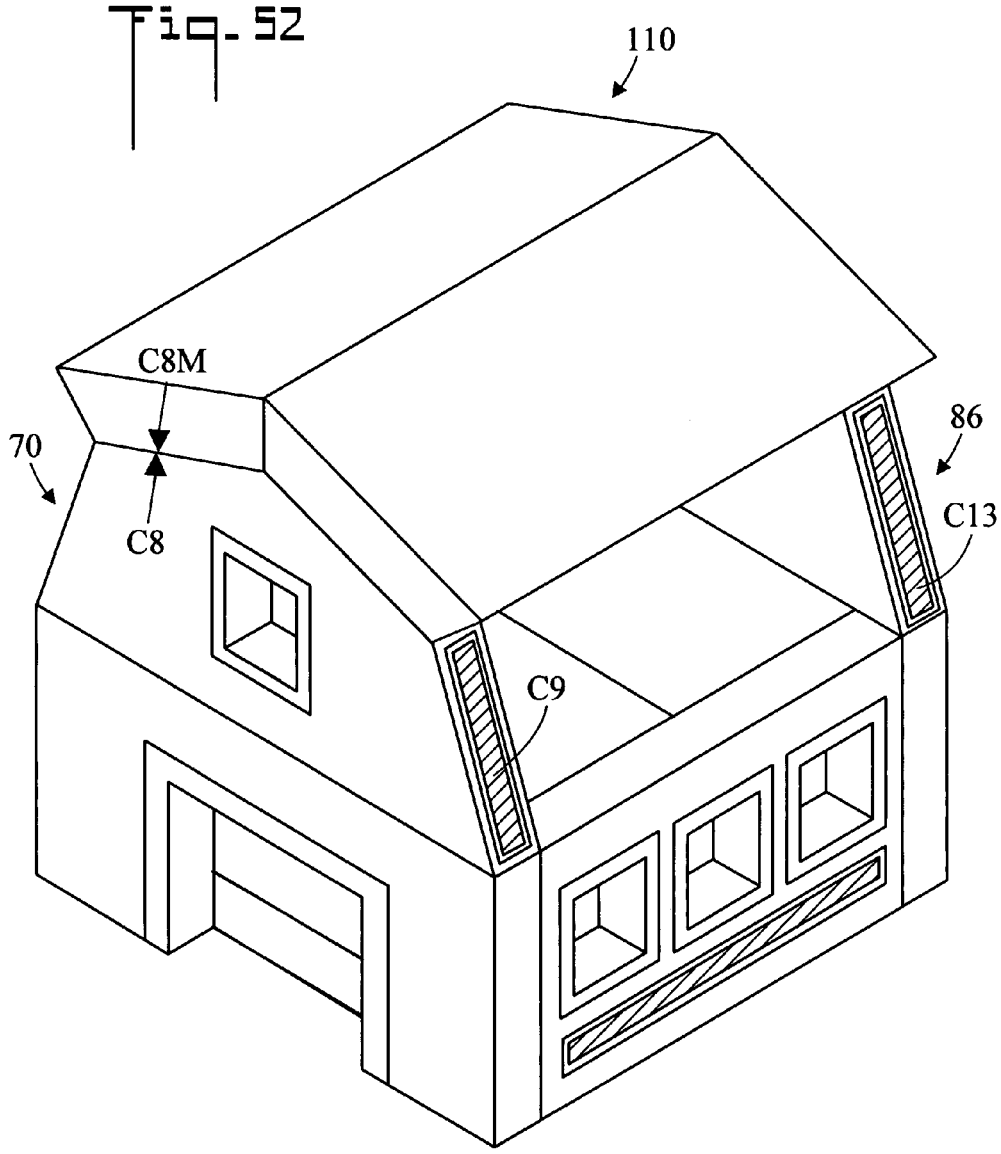
FIG. 52 is a perspective view of the second roof panel connected to the first gable and to the second gable.

FIG. 52 is a perspective view of the second roof panel 110 connected to first gable 70 and to the second gable 86 (connections C8-C8M and C12-C12M (hidden)). Also shown are connectors C9 and C13M.

Figure 53:
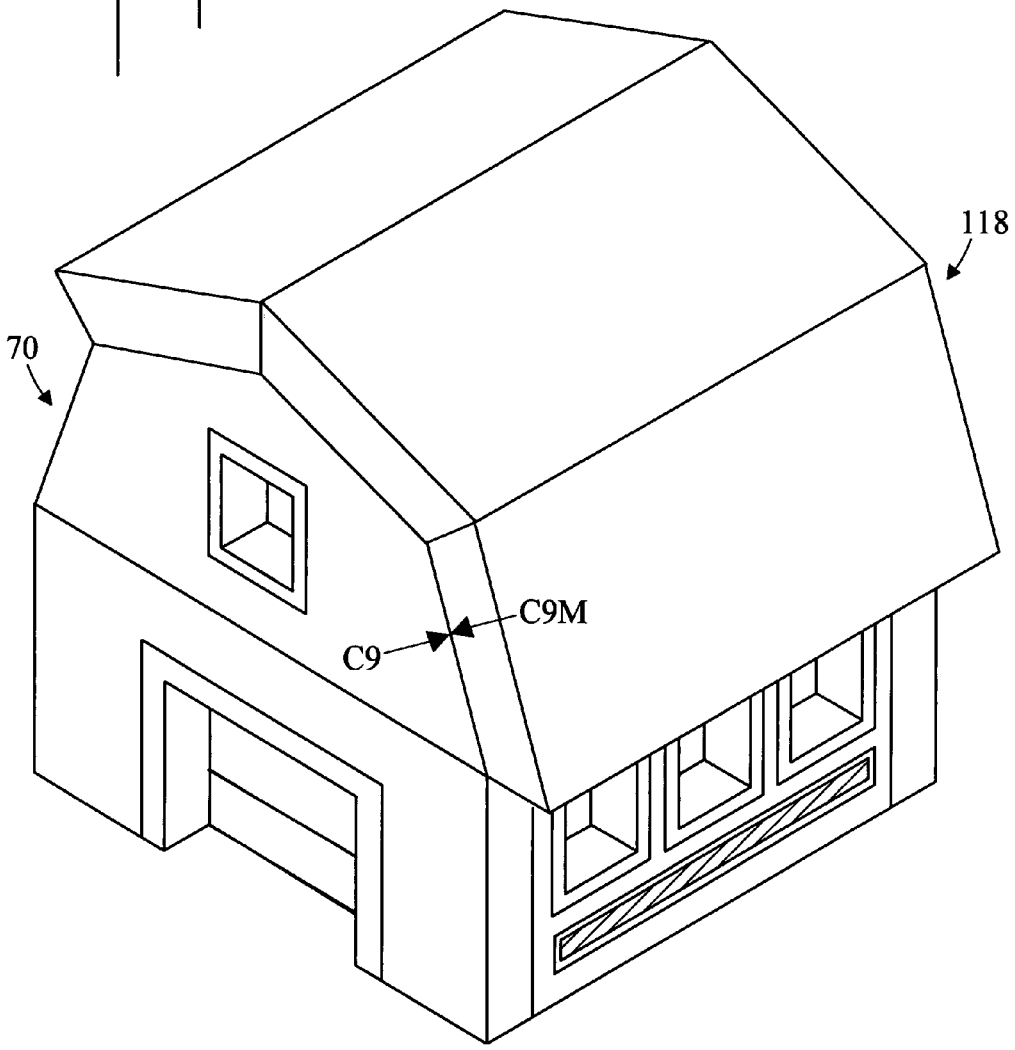
FIG. 53 is a perspective view of the third roof panel connected to the first gable and to the second gable.

FIG. 53 is a perspective view of third roof panel 118 connected to first gable 70 and to second gable 86 (hidden) (connections C9-C9M and C13-C13M (hidden).

Figure 54:
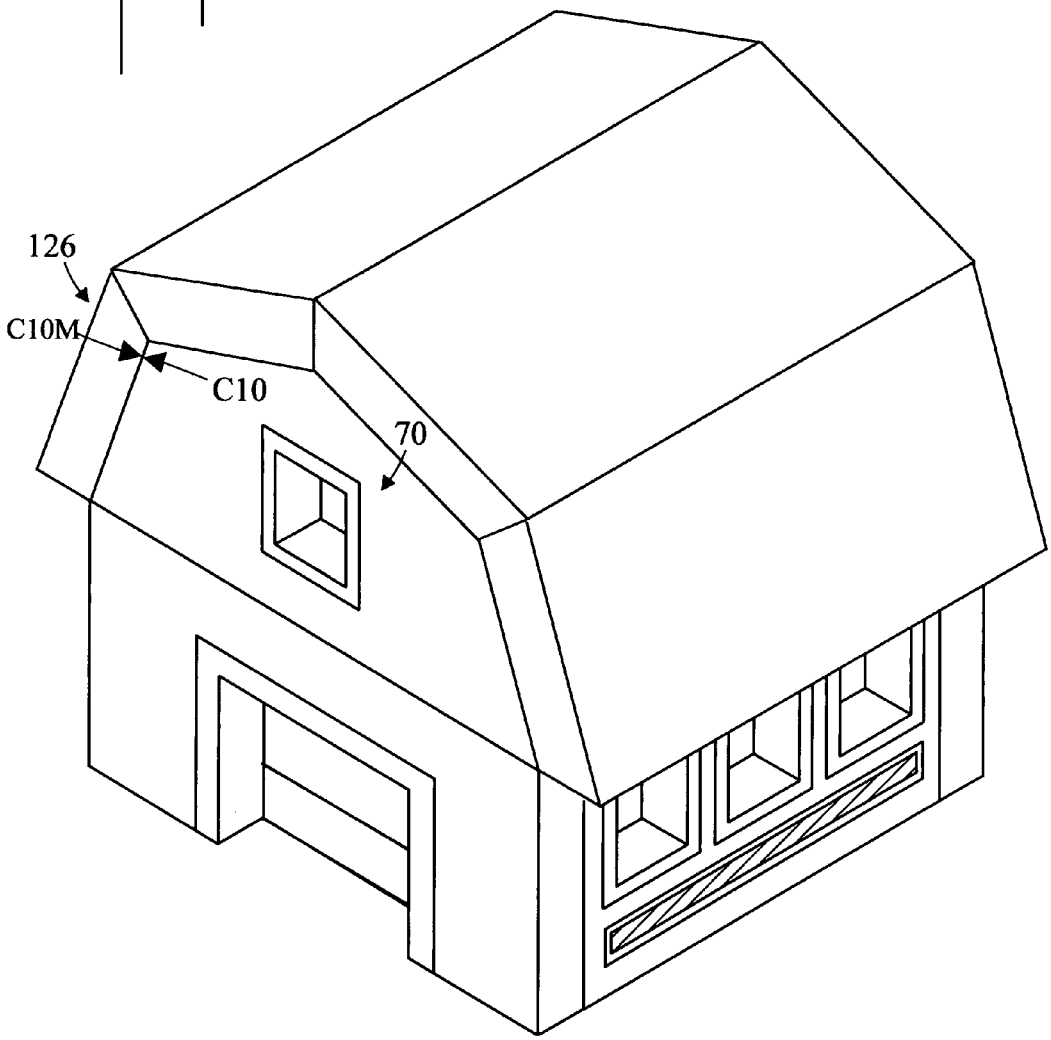
FIG. 54 is a perspective view of the fourth roof panel connected to the first gable and to the second gable.

FIG. 54 is a perspective view of fourth roof panel 126 connected to first gable 70 and to the second gable 86 (hidden) (connections C10-C10M and C140C14M (hidden)). It is also noted that roof panels 102, 110, 118, and 126 can all be first connected together to form a four roof panel assembly, and then the entire four roof panel assembly placed upon the first 70 and second 86 gables.

Figure 55:
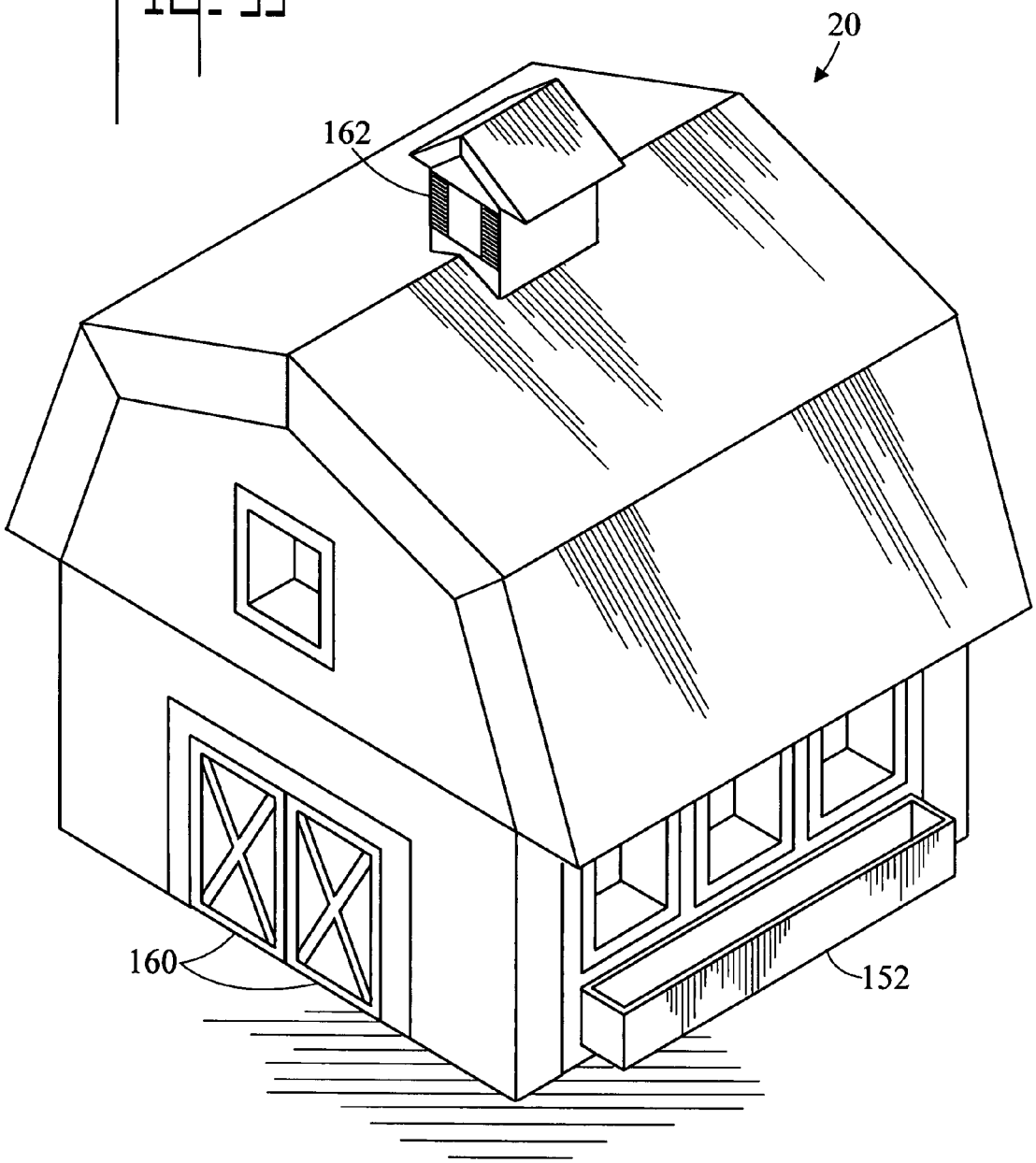
FIG. 55 is a perspective view of the cupola, the barn door, and the hay trough connected to the toy barn; and, FIG. 56 is a rear perspective view of the assembled toy barn.

FIG. 55 is a perspective view of cupola 162, barn doors 160, and hay trough 152 connected to toy barn 20. FIG. 55 shows completely assembled toy barn 20. The size of toy barn 20 can vary. In one embodiment floor 150 is about 16 inches square and the thickness of the walls is about two inches. In other words toy barn 20 has a 20 inch by 20 inch footprint. In one embodiment, when toy barn 20 is assembled it is of sufficient size so that the child can reside inside the walls.

Figure 56:
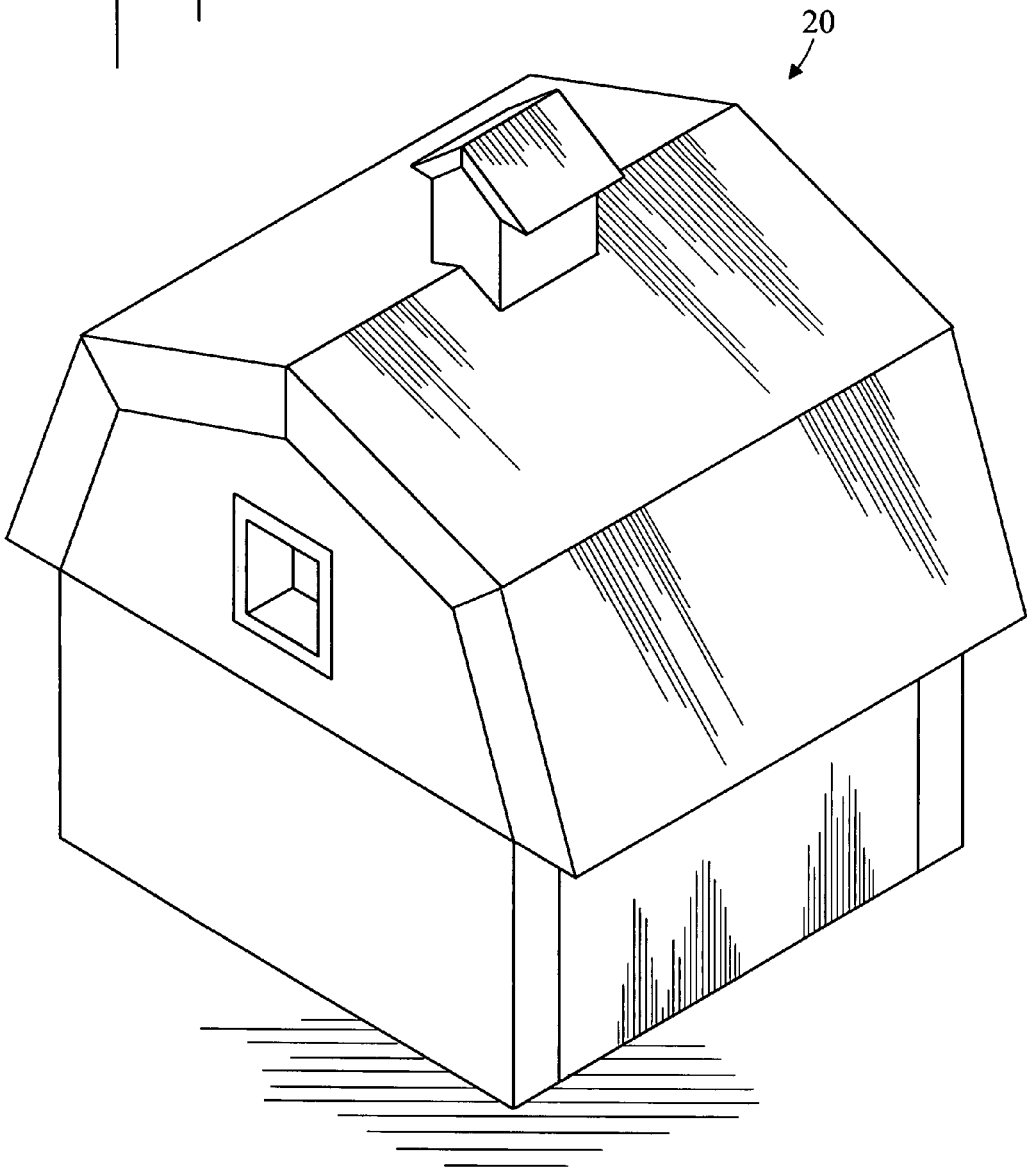

FIG. 56 is a rear perspective view of the assembled toy barn 20.

In terms of use, a method for teaching skills to a child includes: (refer to FIGS. 1-55)

(a) providing apparatus for teaching skills to the child including, the apparatus being a toy barn kit 20 which includes;

- a front wall 22 having a first end 24, an opposite second end 26, and a top edge 28, a first connector C1 of a first color is disposed at first end 24, a second connector C2 of a second color is disposed at second end 26, and a third connector C3 of a third color is disposed at top edge 28;
- a rear wall 38 having a first end 40, an opposite second end 42, and a top edge 44, a fourth connector C4 of a fourth color disposed at first end 40, a fifth connector C5 of a fifth color disposed at second end 42, and a sixth connector C6 of a sixth color disposed at top edge 44;
- a first, side wall 50 is removably connectable to front wall 22 and to rear wall 38, first side 50 wall having a first end 52 and an opposite second end 54, a mating fifth connector C5M of the fifth color disposed at first end 52 and a mating first connector C1M of the first color disposed at second end 54;
- a second side wall 60 is removably connectable to front wall 22 and to rear wall 38, second side wall 60 having a first end 62 and an opposite second end 64, a mating second connector C2M of the second color disposed at first end 62 and a mating fourth connector C4M of the fourth color disposed at second end 64;
- a first gable 70 is removably connectable to front wall 22, first gable 70 having a bottom edge 72, a first upper side edge 74, an opposite second upper side edge 76, a first lower side edge 78, and an opposite second lower side edge 80, a mating third connector C3M of the third color disposed at bottom edge 72, a seventh connector C7 of a seventh color disposed at first upper side edge 74, an eighth connector C8 of an eighth color disposed at second upper side edge 76, a ninth connector C9 of a ninth color disposed at first lower side edge 78, and a tenth connector C10 of a tenth color disposed at second lower side edge 80;

a second gable 86 is removably connectable to rear wall 38, second gable 86 having a bottom edge 88, a first upper side edge 90, an opposite second upper side edge 92, a first lower side edge 94, and an opposite second lower side edge 96. A mating sixth connector C6M of the sixth color is disposed at bottom edge 88, an eleventh connector C11 of an eleventh color disposed at first upper side edge 90, a twelfth connector C12 of a twelfth color is disposed at second upper side edge 92, a thirteenth connector C13 of a thirteenth color is disposed at first lower side edge 94, and a fourteenth connector C14 of fourteenth color is disposed at second lower side edge 96;

a first roof panel 102 is removably connectable to first gable 70 and to second gable 86. First roof panel 102 has a first end 104 and an opposite second end 106, a mating seventh connector C7M of the seventh color disposed at first end 104 and an mating eleventh connector C11M of the eleventh color is disposed at second end 106;

a second roof panel 110 is removably connectable to first gable 70 and to second gable 86. Second roof panel 110 has a first end 112 and an opposite second end 114, a mating eighth connector C8M of the eighth color is disposed at first end 112 and a mating twelfth connector C12M of the twelfth color disposed at second end 114;

a third roof panel 118 is removably connectable to first gable 70 and to second gable 86. Third roof panel 118 has a first end 120 and an opposite second end 122, a mating ninth connector C9 of the ninth color is disposed at first end 120 and a mating thirteenth connector 13M of the thirteenth color is disposed at second end 122;

a fourth roof panel 126 is removably connectable to first gable 70 and to second gable 86. Fourth roof panel 126 has a first end 128 and an opposite second end 130, a mating tenth connector C10 of the tenth color is disposed at first end 128 and a mating fourteenth connector C14 of the fourteenth color is disposed at second end 130; and, each of the first connector C1 through the fourteenth connector C14 being a different color;

(b) the child using first connector C1 of the first color and mating first connector C1M of the first color to connect front wall 22 to first side wall 50;

(c) the child using firth connector C5 of the fifth color and mating fifth connector C5M of the fifth color to connect first side wall 50 to rear wall 38;

(d) the child using fourth connector C4 of the fourth color and mating fourth connector C4M of the fourth color to connect rear war 38 to second side wall 60;

(e) the child using second connector C2 of the second color and mating second connector C2M of the second color to connect second side wall 60 to front wall 22;

(f) the child using third connector C3 of the third color and mating third connector C3M of the third color to connect first gable 70 to front wall 22;

(g) the child using sixth connector C6 of the sixth color and mating sixth connector C6M of the sixth color to connect second gable 86 to rear wall 38;

(h) the child using seventh connector C7 of the seventh color and mating seventh connector C7M of the seventh color to connect first roof panel 102 to first gable 70;

(i) the child using eleventh connector C11 of the eleventh color and mating eleventh connector C11M of the eleventh color to connect first roof panel 102 to second gable 86;

(j) the child using eighth connector C8 of the eighth color and mating eighth connector C8M of the eighth color to connect second roof panel 110 to first gable 70;

(k) the child using twelfth connector C12 of the twelfth color and the mating twelfth connector C12M of the twelfth color to connect second roof panel 110 to second gable 86;

(l) the child using ninth connector C9 of the ninth color and mating ninth connector C9M of the ninth color to connect third roof 118 panel to first gable 70;

(m) the child using thirteenth connector C13 of the thirteenth color and mating thirteenth connector C13M of the thirteenth color to connect third roof panel 118 to second gable 86;

(n) the child using tenth connector C10 of the tenth color and mating tenth connector C10M of the tenth color to connect fourth roof panel 126 to first gable 70;

(o) the child using fourteenth connector C14 of the fourteenth color and mating fourteenth connector C14M of the fourteenth color to connect fourth roof panel to 126 to second gable 86; and, (p) in the performance of steps (b) through (o) the child learning skills of (1) principles of construction, (2) spatial relationships, (3) sequential thinking, and (4) color recognition and matching.

The method further including:

in step (a), first roof panel 102 is removably connectable to second roof panel 110 and to third roof panel 118. First roof panel 22 has a first edge 134 and an opposite second edge 136, a fifteenth connector C15 of a fifteenth color disposed at first edge 134 and a sixteenth connector C16 of a sixteenth color disposed at second edge 136;

in step (a), second roof panel 110 is removably connectable to first roof panel 102 and to fourth roof panel 126. Second roof panel 110 has a first edge 138 and an opposite second edge 140, a mating fifteenth connector C15 of the fifteenth color disposed at first edge 138 and a seventeenth connector C17 of a seventeenth color disposed at second edge;

in step (a), third roof panel 118 is removably connectable to first roof panel 102. Third roof panel 118 has a first edge 142 and an opposite second edge 144, a mating sixteenth connector C16M of the sixteenth color is disposed at first edge 142;

in step (a), fourth roof panel 126 is removably connectable to second roof panel 110. Fourth roof panel 126 has a first edge 146 and an opposite second edge 148, a mating seventeenth connector C17M of the seventeenth color is disposed at first edge 146;

in step (a), each of the first connector C1 through the seventeenth color C17 being a different color during step (j), the child also using fifteenth connector C15 of the fifteenth color and the mating fifteen connector C15M of the fifteenth color to connect second roof panel 110 to first roof panel 102;

during step (l), the child also using sixteenth connector C16 of the sixteenth color and the mating sixteenth connector C16M of the sixteenth color to connect third roof panel 118 to first roof panel 102; and, during step (n), the child also using seventeenth connector C17 of the seventeenth color and mating seventeenth connector C17M of the seventeenth color to connect fourth roof panel 126 to second roof panel 110.

The method further including:

in step (a), each of the roof panels having an inner surface and four edges; and, a stretchable fabric disposed on the inner surface and the four edges.

The method further including:

in step (a), front wall 22, rear wall 38, first side wall 50, second side wall 60, first gable 70, second gable 86, first roof panel 102, second roof panel 110, third roof panel 118, and fourth roof panel 126 each including a foam body which is covered with at least one type of fabric selected from the group of (1) quilted fabric and (2) 100% polyester fabric.

The method further including:

in step (a), front wall 22 including a door opening 34;

in step (a), providing a barn door 160 which is shaped and dimensioned to removable fit into door opening 34 but not connect to front wall 22;

the child placing barn door 160 in door opening 34 in front wall 22.

The method further including:

in step (a), first side wall 50 having an exterior surface 56 and at least one window opening 154;

in step (a), an eighteenth connector C18 of an eighteenth color is disposed on exterior surface 56 below window opening 34;

in step (a), providing a hay trough 150 having a rear surface 156, a mating eighteenth connector C18M of the eighteenth color disposed on rear surface 156, so that hay trough 150 can be mounted on exterior surface 56 of first side wall 50 below window opening 154;

each of first connector C1 through eighteenth connector C18 being a different color; and, the child using eighteenth connector C18 of the eighteenth color and the mating eighteenth connector C18M of the eighteenth color to connect hay trough 150 to the exterior surface 56 of first side wall 50.

The method further including:

in step (a), providing a cupola 162 which is shaped and dimensioned to removably rest on first roof panel 102 and on second roof panel 110, cupola 162 not fixedly connectable to first 102 and second 110 roof panels; and, after step (k), the child placing cupola 162 on first 102 and second 110 roof panels.

The method also including an adult, further including:

performing steps (b) through (o) with the adult physically assisting the child in making the various connections;

next performing steps (b) through (o) with the adult instructing the child but not providing physical assistance; and, next the child performing steps (b) through (o) with no adult assistance or instruction.

The possible embodiments of the method and apparatus described herein are exemplary and numerous modifications, combinations, variations, and rearrangements can be readily envisioned to achieve an equivalent result, all of which are intended to be embraced within the scope of the appended claims. Further, nothing in the above-provided discussions of the method and apparatus should be construed as limiting the invention to a particular embodiment or combination of embodiments. The scope of the invention is best defined by the appended claims.

I claim:

1. Apparatus for teaching skills to a child, comprising:

a toy barn kit including;

a front wall having a first end, an opposite second end, and a top edge, a first connector of a first color disposed at said first end, a second connector of a second color disposed at said second end, and a third connector of a third color disposed at said top edge;

a rear wall having a first end, an opposite second end, and a top edge, a fourth connector of a fourth color disposed at said first end, a fifth connector of a fifth color disposed at said second end, and a sixth connector of a sixth color disposed at said top edge;

a first side wall removably connectable to said front wall and to said rear wall, said first side wall having a first end and an opposite second end, a mating fifth connector of said fifth color disposed at said first end and a mating first connector of said first color disposed at said second end;

a second side wall removably connectable to said front wall and to said rear wall, said second side wall having a first end and an opposite second end, a mating second connector of said second color disposed at said first end and a mating fourth connector of said fourth color disposed at said second end;

a first gable removably connectable to said front wall, said first gable having a bottom edge, a first upper side edge, an opposite second upper side edge, a first lower side edge, and an opposite second lower side edge, a mating third connector of said third color disposed at said bottom edge, a seventh connector of a seventh color disposed at said first upper side edge, an eighth connector of an eighth color disposed at said second upper side edge, a ninth connector of a ninth color disposed at said first lower side edge, and a tenth connector of a tenth color disposed at said second lower side edge;

a second gable removably connectable to said rear wall, said second gable having a bottom edge, a first upper side edge, an opposite second upper side edge, a first lower side edge, and an opposite second lower side edge, a mating sixth connector of said sixth color disposed at said bottom edge, an eleventh connector of an eleventh color disposed at said first upper side edge, a twelfth connector of a twelfth color disposed at said second upper side edge, a thirteenth connector of a thirteenth color disposed at said first lower side edge, and a fourteenth connector of fourteenth color disposed at said second lower side edge;

a first roof panel removably connectable to said first gable and to said second gable, said first roof panel having a first end and an opposite second end, a mating seventh connector of said seventh color disposed at said first end and a mating eleventh connector of said eleventh color disposed at said second end;

a second roof panel removably connectable to said first gable and to said second gable, said second roof panel having a first end and an opposite second end, a mating eighth connector of said eighth color disposed at said first end and a mating twelfth connector of said twelfth color disposed at said second end;

a third roof panel removably connectable to said first gable and to said second gable, said third roof panel having a first end and an opposite second end, a mating ninth connector of said ninth color disposed at said first end and a mating thirteenth connector of said thirteenth color disposed at said second end;

a fourth roof panel removably connectable to said first gable and to said second gable, said fourth roof panel having a first end and an opposite second end, a mating tenth connector of said tenth color disposed at said first end and a mating fourteenth connector of said fourteenth color disposed at said second end;

each of said first connector through said fourteenth connector being a different color;

wherein each said color is used to make a single connection;

said first roof panel removably connectable to said second roof panel and to said third roof panel, said first roof panel having a first edge and an opposite second edge, a fifteenth connector of a fifteenth color disposed at said first edge and a sixteenth connector of a sixteenth color disposed at said second edge;

said second roof panel removably connectable to said first roof panel and to said fourth roof panel, said second roof panel having a first edge and an opposite second edge, a mating fifteenth connector of said fifteenth color disposed at said first edge and a seventeenth connector of a seventeenth color disposed at said second edge;

said third roof panel removably connectable to said first roof panel, said third roof panel having a first edge and an opposite second edge, a mating sixteenth connector of said sixteenth color disposed at said first edge;

said fourth roof panel removably connectable to said second roof panel, said fourth roof panel having a first edge and an opposite second edge, a mating seventeenth connector of said seventeenth color disposed at said first edge;

each of said roof panels having an inner surface and four edges;

a stretchable fabric disposed on said inner surface and said four edges;

said front wall said rear wall, said first side wall, said second side wall, said first gable, said second gable, said first roof panel, said second roof panel, said third roof panel, and said fourth roof panel each including a foam body which is covered with at least one type of fabric selected from the group of (1) quilted fabric and (2) 100% polyester fabric;

said front wall including a door opening;

a barn door which is shaped and dimensioned to removable fit into said door opening but not connect to said front wall;

said first side wall having an exterior surface and at least one window opening;

an eighteenth connector of an eighteenth color disposed on said exterior surface below said window opening;

a hay trough having a rear surface, a mating eighteenth connector of said eighteenth color disposed on said rear surface;

so that said hay trough can be mounted on said exterior surface of said first side wall below said window opening;

a cupola shaped and dimensioned to removably rest on said first roof panel and on said second roof panel, said cupola not fixedly connectable to said first and second roof panels;

said connectors including the following layers;

a layer of hook or loop material;

a layer of colored broad cloth disposed underneath said hook or loop material;

a layer of felt disposed underneath said colored broad cloth;

a layer of quilted fabric disposed underneath said felt;

a layer of foam;

said layer of hook or loop material sewn to said layer of colored broad cloth;

said layer of colored broadcloth sewn to said layer of felt;

all of said layers glued together; and, each of said first connector through said eighteenth connector being a different color.

* * * * *